US006072969A

United States Patent [19]

Yokomori et al.

[11] Patent Number: 6,072,969

[45] **Date of Patent: *Jun. 6, 2000**

[54] DEVELOPING CARTRIDGE

[75] Inventors: Kanji Yokomori, Odawara; Hisayoshi Kojima, Mishima; Kazuhiko Kanno, Numazu, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/813,949

[22] Filed: Mar. 3, 1997

[30] Foreign Application Priority Data

| | | | |
|---|---|---|---|
| Mar. 5, 1996 | [JP] | Japan | 8-047375 |
| Mar. 5, 1996 | [JP] | Japan | 8-047376 |
| Mar. 3, 1997 | [JP] | Japan | 9-047844 |

[51] Int. Cl.[7] ..... G03G 21/16

[52] U.S. Cl. ..... 399/119; 399/262; 399/223; 399/227

[58] Field of Search ..... 399/119, 120, 399/262, 263, 223, 226, 227

[56] References Cited

U.S. PATENT DOCUMENTS

| | | | |
|---|---|---|---|
| 4,583,832 | 4/1986 | Kasamura et al. | 355/3 DD |
| 4,622,916 | 11/1986 | Tanaka et al. . | |
| 4,866,482 | 9/1989 | Hirasawa et al. | 355/260 |
| 4,916,490 | 4/1990 | Tanaka et al. | 355/245 |
| 4,922,301 | 5/1990 | Katoh et al. . | |
| 5,198,866 | 3/1993 | Kimura et al. | 355/326 |
| 5,235,383 | 8/1993 | Tada et al. | 355/200 |
| 5,442,421 | 8/1995 | Kojima | 355/211 |
| 5,471,284 | 11/1995 | Fujii et al. | 355/210 |
| 5,497,220 | 3/1996 | Inomata et al. | 355/245 |
| 5,521,693 | 5/1996 | Kojima et al. | 355/326 R |
| 5,565,973 | 10/1996 | Fujishiro et al. . | |
| 5,585,598 | 12/1996 | Kasahara et al. . | |
| 5,587,783 | 12/1996 | Nakamura et al. . | |
| 5,666,613 | 9/1997 | Kumon et al. | 399/227 |
| 5,671,465 | 9/1997 | Kimura et al. | 399/119 |
| 5,671,470 | 9/1997 | Maruta et al. | 399/235 |

FOREIGN PATENT DOCUMENTS

| | | |
|---|---|---|
| 0613060 | 8/1994 | European Pat. Off. . |
| 0644465 | 3/1995 | European Pat. Off. . |
| 58-134663 | 8/1983 | Japan . |
| 60-26377 | 2/1985 | Japan . |
| 2185914 | 8/1987 | United Kingdom . |

*Primary Examiner*—Richard Moses

*Attorney, Agent, or Firm*—Fitzpatrick, Cella, Harper & Scinto

[57] ABSTRACT

A developing cartridge for developing a latent image formed on the photosensitive member, wherein the developing cartridge is detachably mountable to a main assembly of an electrophotographic image forming apparatus, the developing cartridge includes a cartridge frame; developing means for developing, with toner, the latent image formed on the photosensitive member of the main assembly of the apparatus; a first projected portion outwardly projected from the cartridge frame portion adjacent one longitudinal end of the developing means; a second projected portion outwardly projected from the cartridge frame portion adjacent the other longitudinal end of the developing means; a first urging force receptor portion outwardly projected from the cartridge frame portion adjacent one longitudinal end of the developing means; a second urging force receptor portion outwardly projected from the cartridge frame portion adjacent the other longitudinal end of the developing means; a first contact portion outwardly projected from the cartridge frame portion adjacent one longitudinal end of the developing means; a second contact portion outwardly projected from the cartridge frame portion adjacent one longitudinal end of the developing means.

62 Claims, 26 Drawing Sheets

DEVELOPING CARTRIDGE

BACKGROUND OF THE INVENTION

FIELD OF THE INVENTION

The present invention relates to a developing cartridge for developing a latent image formed on an electrophotographic photosensitive member when an image is formed on a recording material through an electrophotographic process, and an electrophotographic image forming apparatus using the developing cartridge.

Heretofore, the following structure is known as a multi-color image forming apparatus for forming a multi-color image on a recording material through an electrophotographic process. A plurality of developing devices accommodating different color developers which are arranged on a rotation selection mechanism, are disposed around an electrophotographic photosensitive drum. A developing device accommodating a color developer is brought to face the photosensitive drum to develop a latent image thereon. The developed image is transferred onto the recording material. The developing and transferring operations are carried out for respective colors, so that a multi-color image is formed. The developing device is in the form of a cartridge which is detachably mountable to the main assembly of the image forming apparatus to facilitate the maintenance operation of the users.

Generally, the structure for inserting the developing device into the main assembly of the apparatus is such that the developing device is inserted in the longitudinal direction of the developing roller from a predetermined position, in order to reduce the area of the opening of the main assembly.

The present invention is intended to further improve such a developing device.

SUMMARY OF THE INVENTION

Accordingly, a principal object of the present invention is to provide a developing cartridge having improved operability and an image forming apparatus to which the developing cartridge is detachably mountable.

It is another object of the present invention to provide a developing cartridge which can be correctly positioned in a main assembly of an image forming apparatus, and to provide an image forming apparatus to which the developing cartridge is detachably mountable.

It is a further object of the present invention to provide a developing cartridge which is provided with a positioning member for positioning the cartridge in the main assembly of an image forming apparatus, and to provide an image forming apparatus to which the developing cartridge is detachably mountable.

It is a further object of the present invention to provide a developing cartridge having an outward projection to be supported by a supporting portion in a main assembly of an image forming apparatus, and to provide an image forming apparatus to which the developing cartridge is detachably mountable.

It is a further object of the present invention to provide a developing cartridge having an outward projection for receiving an urging force from an elastic member in a main assembly of an image forming apparatus, and to provide an image forming apparatus to which the developing cartridge is detachably mountable.

According to an aspect of the present invention, there is provided a developing cartridge for developing a latent image formed on the photosensitive member, wherein the developing cartridge is detachably mountable to a main assembly of an electrophotographic image forming apparatus, the developing cartridge comprising: a cartridge frame; developing means for developing, with toner, the latent image formed on the photosensitive member of the main assembly of the apparatus, when mounted to the main assembly of the electrophotographic image forming apparatus; a first projected portion outwardly projected from the cartridge frame portion adjacent one longitudinal end of the developing means, wherein the first projected portion is supported by a first supporting member provided in the main assembly of the apparatus when the cartridge is mounted to the main assembly; a second projected portion outwardly projected from the cartridge frame portion adjacent the other longitudinal end of the developing means, wherein the second projected portion is supported by a second supporting member provided in the main assembly of the apparatus when the cartridge is mounted to the main assembly; a first urging force receptor portion outwardly projected from the cartridge frame portion adjacent one longitudinal end of the developing means, wherein the first urging force receptor portion receives an urging force by a first elastic member provided in the main assembly when the cartridge is mounted to the main assembly; a second urging force receptor portion outwardly projected from the cartridge frame portion adjacent the other longitudinal end of the developing means, wherein the second urging force receptor portion receives an urging force by a second elastic member provided in the main assembly when the cartridge is mounted to the main assembly; a first contact portion outwardly projected from the cartridge frame portion adjacent one longitudinal end of the developing means, wherein the first contact portion contacts a first fixed portion provided in the main assembly when the cartridge is mounted to the main assembly; a second contact portion outwardly projected from the cartridge frame portion adjacent one longitudinal end of the developing means, wherein the second contact portion contacts a second fixed portion provided in the main assembly when the cartridge is mounted to the main assembly.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

A developing cartridge and an electrophotographic image forming apparatus according to embodiments of the present invention will be described.

(First Embodiment)

Figure 1:
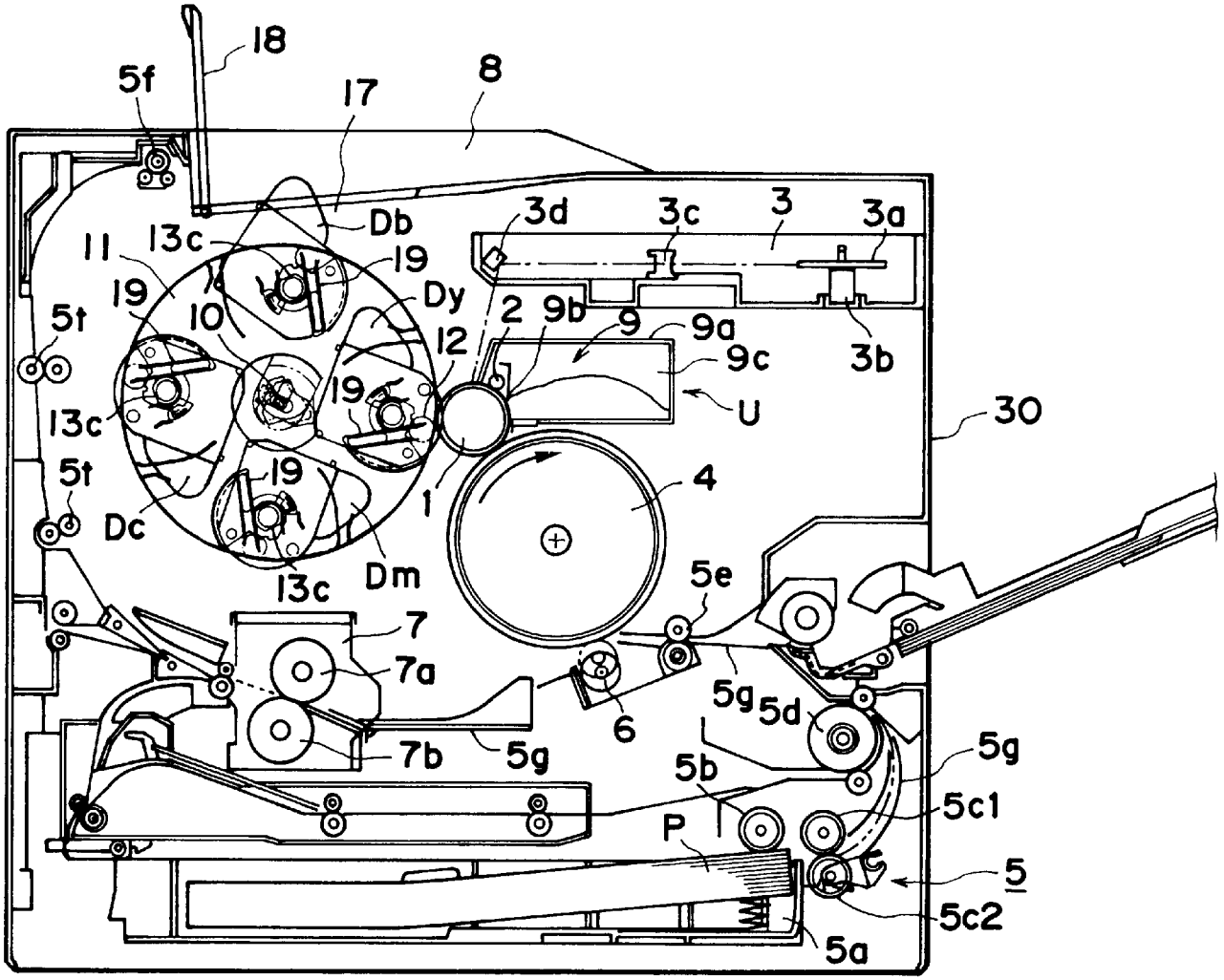
FIG. 1 is an illustration of an electrophotographic image forming apparatus according to an embodiment of the present invention.
Figure 2:
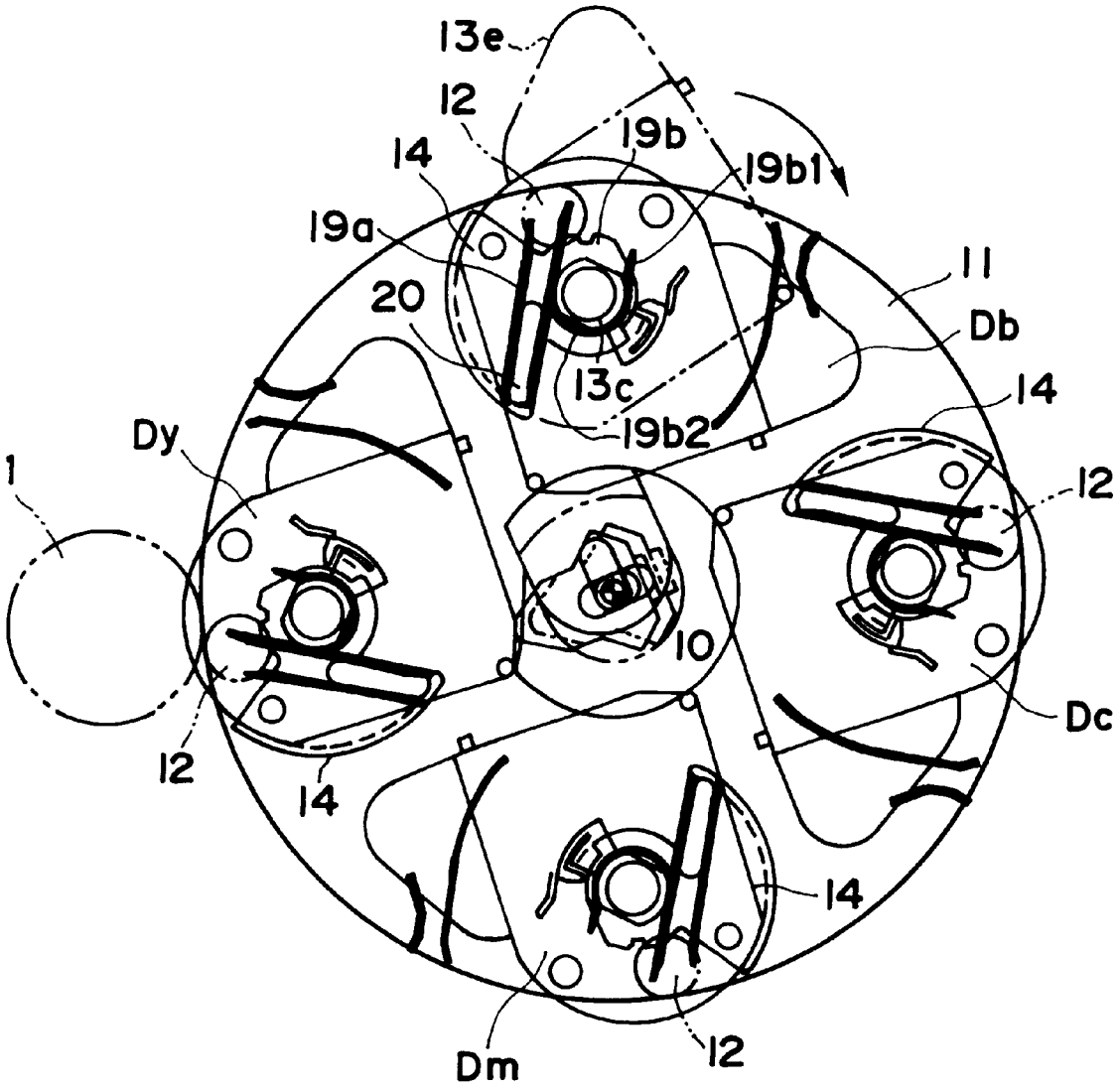
FIG. 2 is an illustration of a rotary unit and a developing cartridge.
Figure 3:
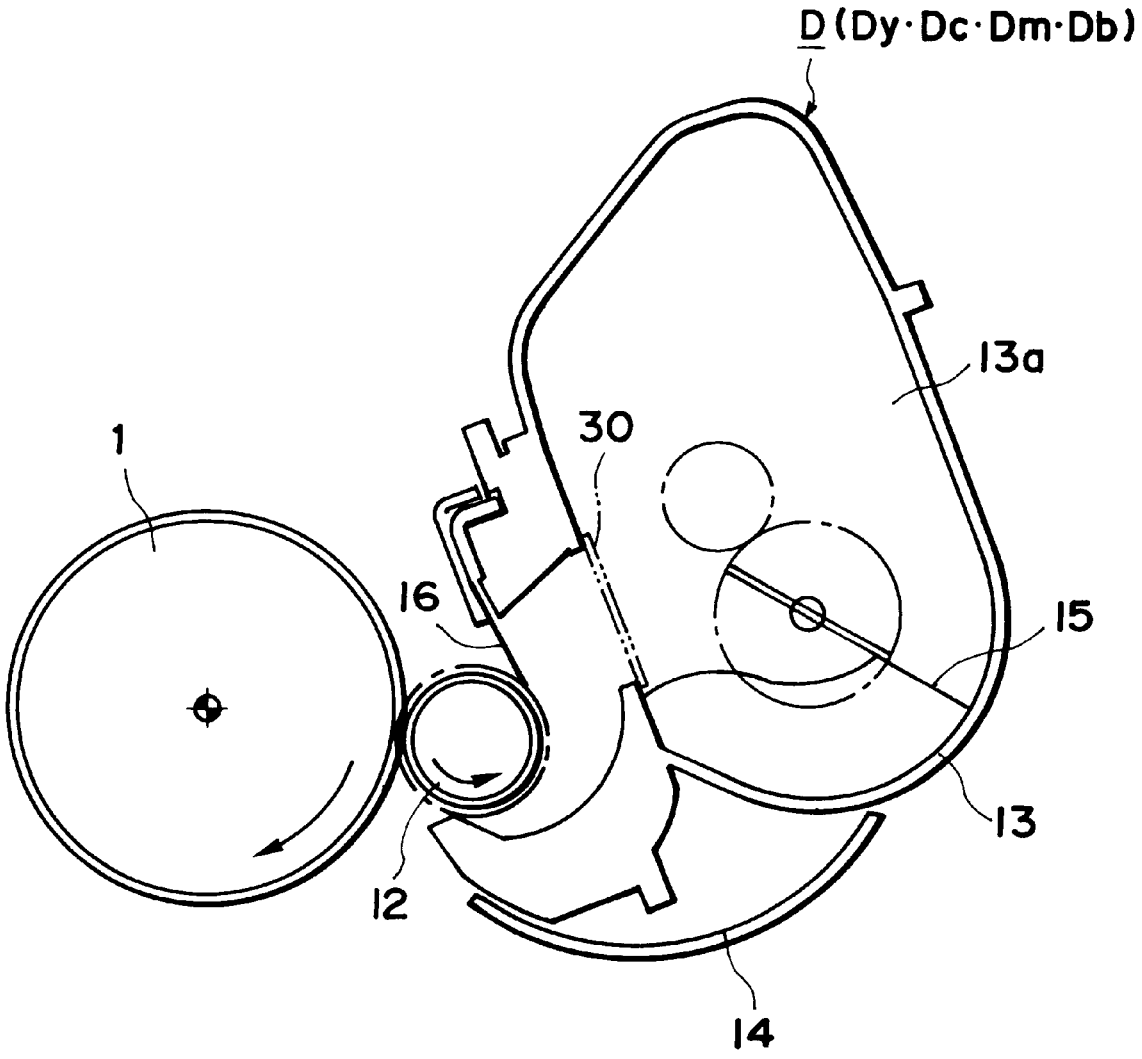
FIG. 3 is an illustration of a developing cartridge.
Figure 4:
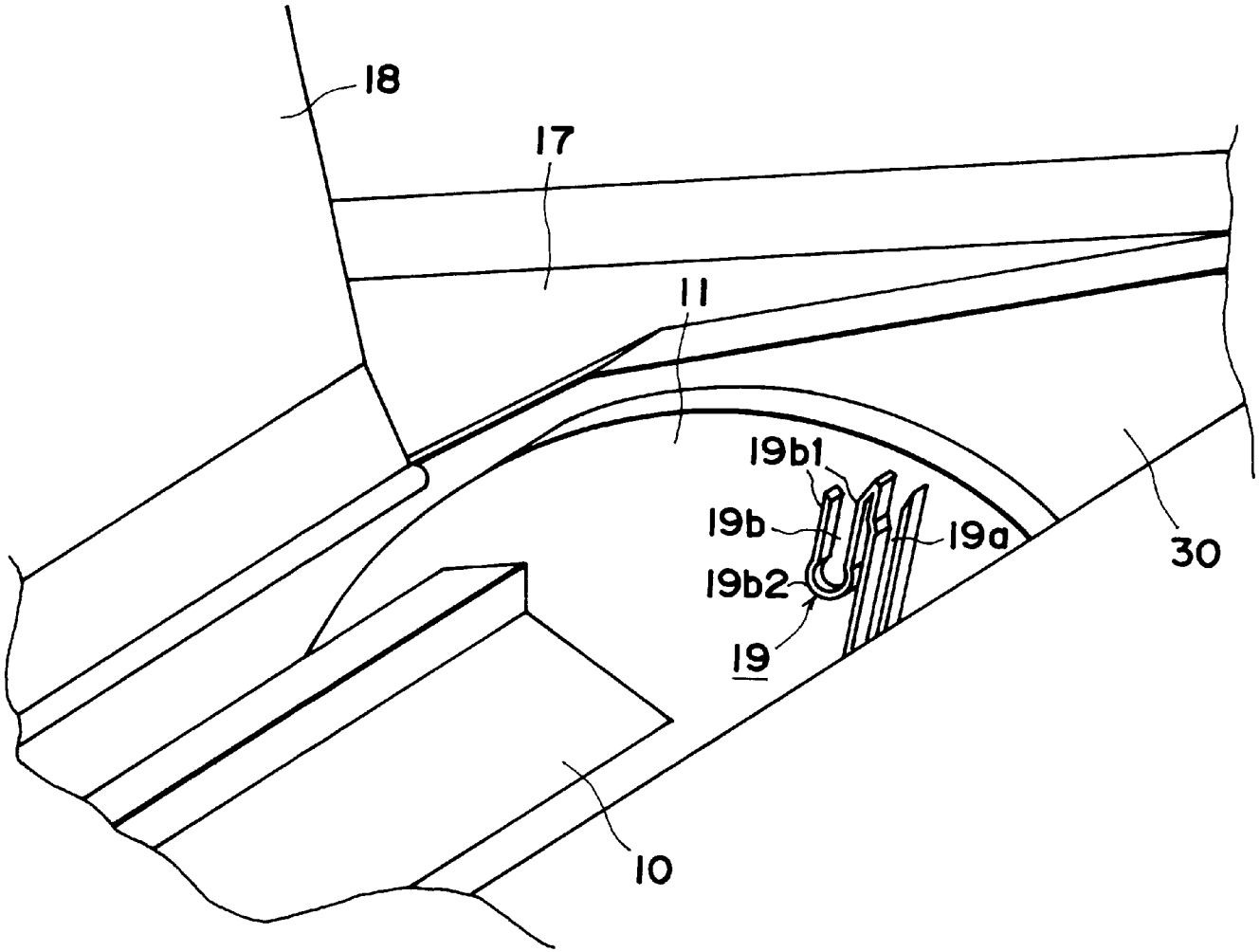
FIG. 4 is an illustration of a mounting means for a developing cartridge, provided in the main assembly of an image forming apparatus.
Figure 5:
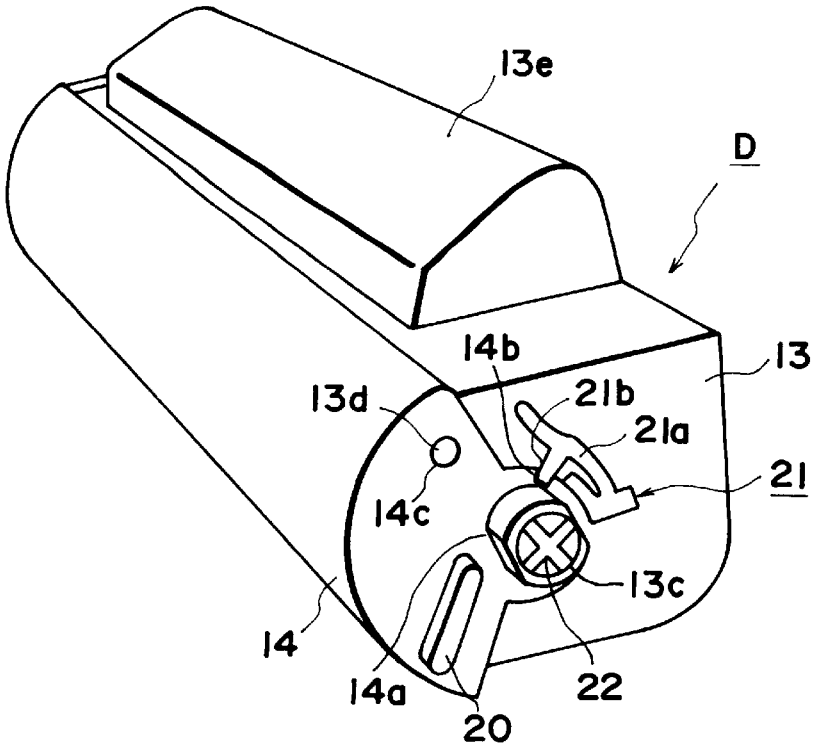
FIG. 5 is a perspective view of a developing cartridge when the shutter is closed.
Figure 9:
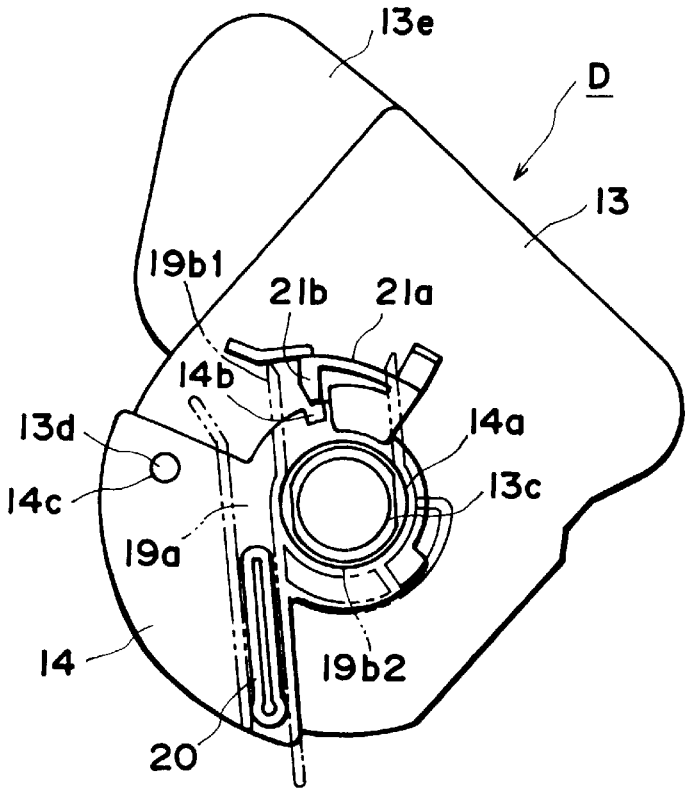
FIG. 9 is an illustration of a developing cartridge when it is inserted into a main assembly.
Figure 10:
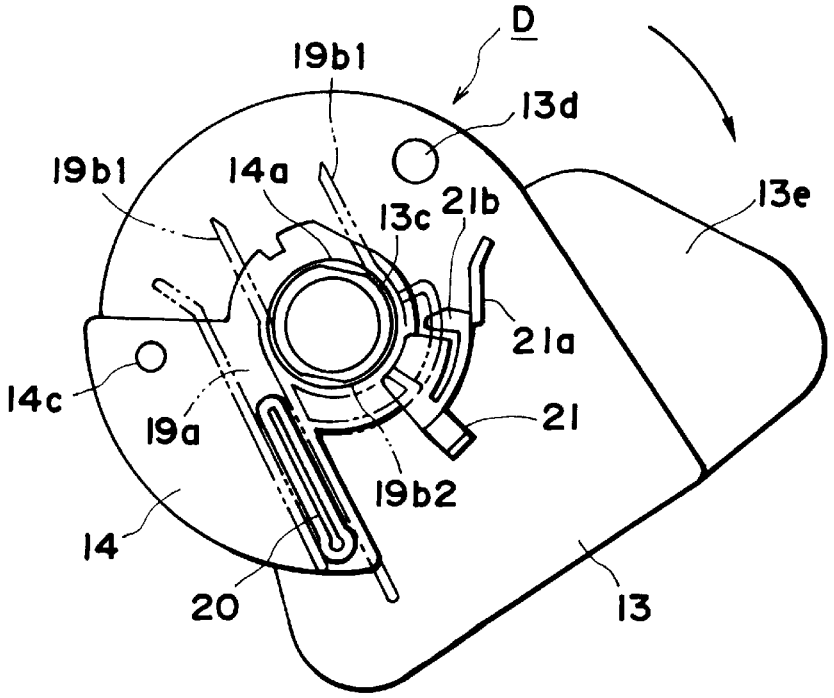
FIG. 10 is an illustration of a developing cartridge when it is inserted into a main assembly.
Figure 11:
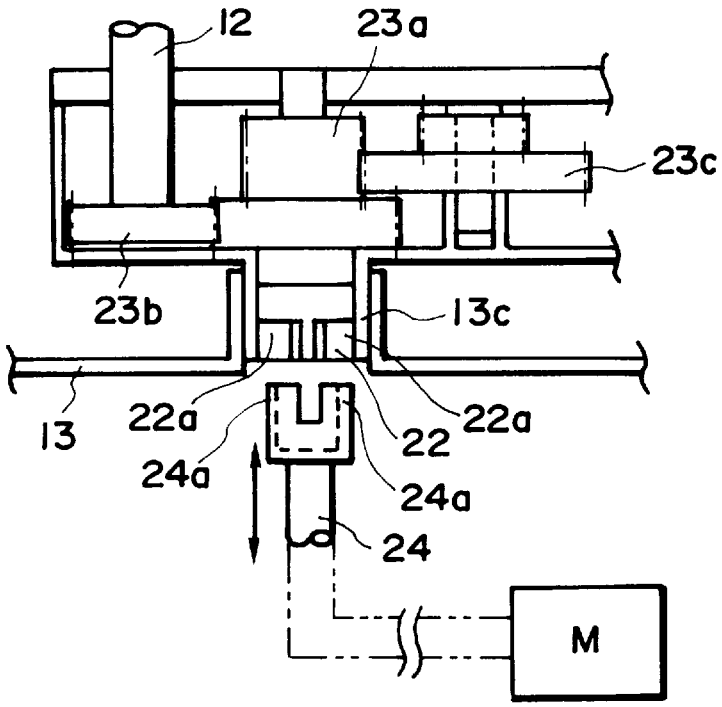
FIG. 11 is an illustration of a drive transmission structure which stabilizes a positional relation between a developing roller and a photosensitive drum.
Figure 12:
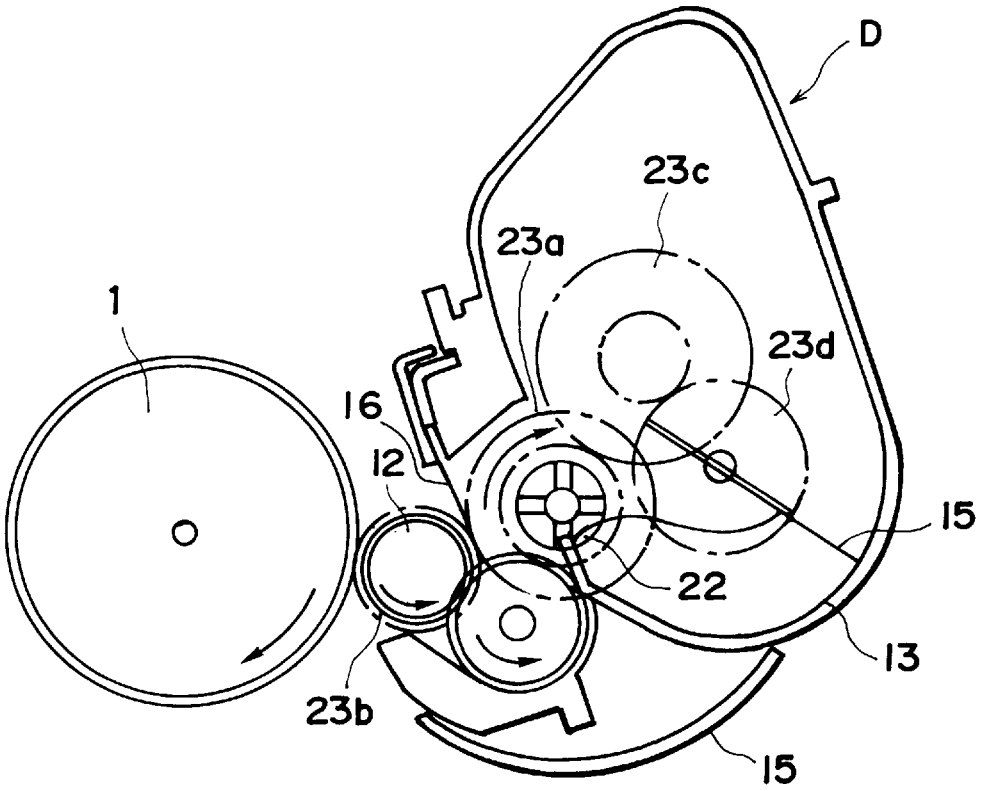
FIG. 12 is an illustration of a drive transmission structure which stabilizes a positional relation between a developing roller and a photosensitive drum.

Referring to FIGS. 1 to 12, the first embodiment of the present invention will be described. FIGS. 1 to FIG. 3 illustrate an electrophotographic image forming apparatus; FIGS. 4 to 5 are perspective views of a developing cartridge; FIGS. 6 to FIG. 10 are a mounting structure of the developing cartridge; and FIGS. 11 and 12, illustrate a drive transmission structure.

First, a description will be provided as to a general arrangement of the electrophotographic image forming apparatus, and then as to the structure of the developing cartridge.

(Electrophotographic Image Forming Apparatus)

The general arrangement of the electrophotographic image forming apparatus of this embodiment will be described. FIG. 1 is a side view of a laser beam printer as an exemplary image forming apparatus for forming a color image through an electrophotographic process. Charging means 2 uniformly charges a surface of an electrophotographic photosensitive member in the form of a drum (photosensitive drum) 1 which rotates at a constant speed. A laser beam corresponding to image information is projected through exposure means 3 onto the photosensitive drum 1 to form latent images thereon, which are developed by developing device Dy, Dm, Dc or Db. The developed images formed on the photosensitive drum 1 are superimposedly transferred sequentially onto an intermediary transfer member 4 so that a color image is formed. The color image is transferred by transferring means 6 onto a recording material P, such as recording paper, OHP sheet or the like fed by feeding means 5 from a sheet feeding portion. The recording material P is fed to fixing means 7, where the color image is fixed. The recording material P is then discharged to a discharging portion 8 at an upper surface of the device.

The structures of the respective portions will be described.

The photosensitive drum 1 is integrally mounted to a frame of cleaning means 9 for removing developer (toner) remaining on the photosensitive drum 1 after transfer of the toner image onto the recording material P, thus constituting a process cartridge (drum unit) U. The process cartridge U is demountably mounted to the main assembly of the image forming apparatus, and is exchanged by a user by himself when the lifetime of the photosensitive drum 1 ends.

The photosensitive drum 1 comprises an aluminum cylinder having a diameter of approximately 50 mm, and an organic photoconductive layer thereon, and is rotatably supported on a frame 9*a* of the cleaning means 9, which frame also functions as a holder for the photosensitive drum 1. Around the photosensitive drum 1, there are provided a cleaning blade 9*b* for scraping and removing the toner remaining on the photosensitive drum 1, and charging means 2. In this example, the photosensitive drum 1, the cleaning means 9 and the charging means 2 are unified into a process cartridge U detachably mountable to the main assembly of the apparatus.

The photosensitive drum 1 receives a driving force from an unshown driving motor to rotate in the counterclockwise direction in FIG. 1 in accordance with an image forming operation.

The charging means 2 in this example is of contact charging type, and comprises a rotatable electroconductive roller in contact with the surface of the photosensitive drum 1, which roller is supplied with a voltage to uniformly charge the surface of the photosensitive drum 1.

In the exposure means 3 for exposing the charged photosensitive drum 1, an image signal is supplied to an unshown laser diode, in response to which the laser diode projects the image light corresponding to the image signal onto the polygonal mirror 3*a*. The polygonal mirror 3*a* is rotated at a high speed by a scanner motor 3*b*, and the image light reflected by the mirror 3*a* is projected onto the photosensitive drum 1 rotating at a constant speed through an imaging lens 3*c* and a reflection mirror 3*d*, so that surface of the photosensitive drum 1 is imagewisely exposed to the light, thus forming an electrostatic latent image.

The latent image is developed for each color by the latent image developing cartridge (developing device). The structure of the developing cartridge will be described, hereinafter.

The toner image developed by the developing cartridge is transferred onto the intermediary transfer member 4. Onto the intermediary transfer member 4, four color toner images on the drum are sequentially and superimposedly transferred. Therefore, the intermediary transfer member 4 is rotated clockwise in FIG. 1 in synchronism with the outer peripheral speed of the photosensitive drum 1. The intermediary transfer member 4 having the toner images is passed to sandwich the recording material P with a transfer roller 6 as transferring means supplied with a voltage, by which the toner images are simultaneously transferred from the intermediary transfer member 4 onto the recording material P.

The intermediary transfer member 4 in this example comprises an aluminum cylinder having an outer diameter of approximately 150 mm, and an elastic layer of a material such as an intermediate resistance sponge, an intermediate resistance rubber or the like thereon. It is rotated by a gear fixed thereto.

After the toner image is transferred onto the intermediary transfer member 4, a small amount of toner remains on the surface of the photosensitive drum 1, and is removed by cleaning means 9. The cleaning means 9 has a cleaning blade 9*b* which contacts the drum surface and which scrapes the toner off the drum surface. The scraped toner is accumulated in a toner container 9*c*. The capacity of the container 9*c* is such that it is not filled with the removed toner accumulated before the lifetime of the photosensitive drum 1 ends. The removed toner in the container 9*c* is taken out by exchange of the drum unit U when the life of the photosensitive drum 1 ends.

The transferring means for transferring the toner images from the intermediary transfer member 4 onto the recording material P, is in the form of a transfer roller 6 in this example, and the roller 6 comprises a metal shaft and an intermediate resistance foamed-elastic-member thereon, and is vertically movable in FIG. 1.

The transfer roller 6 takes a solid line position in FIG. 1 (lower position) away from the intermediary transfer member 4 so that it does not disturb the image while the four toner images are being transferred thereonto, that is, while the intermediary transfer member 4 is rotated a plurality of times.

After the toner images are superimposedly transferred onto the intermediary transfer member 4, and the color image formation is completed on the intermediary transfer member 4, the transfer roller 6 is moved to the upper position indicated by the chain line in FIG. 1 by an unshown cam at a timing for transfer of the color image onto the recording material P. Thus, the roller press-contacts the recording member P to the intermediary transfer member 4 at a predetermined time. Simultaneously with this, the transfer roller 6 is supplied with a bias voltage so that a toner image is transferred from the intermediary transfer member 4 onto the recording material P.

The feeding means 5 for feeding the recording material P, comprises a cassette 5*a* accommodating a plurality of recording materials P, a pick-up roller 5*b*, feeding rollers 5*c*1, retarding rollers 5*c*2 for preventing double feeding, a pair of feeding rollers 5*d*, a pair of registration rollers 5*e*, a pair of discharging rollers 5*f*, and a feeding guide 5*g*.

At the time of the image formation, the pickup roller 5*a* is rotated in the image forming operation, so that recording material P in the cassette 5*a* is separated and fed in seriatim. The recording material is fed out of the cassette 5*a*, and is guided by the feeding guide 5*f*, and then is fed to the pair of registration rollers 5*e* via the pair of feeding rollers 5*d*. In the image forming operation, the registration roller 5*e* is at rest for stopping and retaining the recording material P, and is rotated to feed the recording material P to the intermediary transfer member 4 at a predetermined sequence to align the recording material P with the intermediary transfer member 4 for the transfer process. Then, the color image is transferred by the transferring means.

The recording material P now having the transferred color image is fed to the fixing means 7 where the toner image is fixed. The fixing means 7 comprises a fixing roller 7*a* for applying heat to the recording material P, and a pressing roller 7*b* for press-contacting the recording material P to the fixing roller 7*a*. These rollers 7*a*, 7*b* are hollow rotatable rollers, and have heaters therein. The toner image is fixed on the recording material P while the recording material P is being fed therethrough while being pressed and heated.

The recording material P on which the toner image is fixed, is discharged to the discharging portion 8 by the discharging rollers 5*f* (feeding means).

(Developing Cartridge (Developing Device))

A description will be provided as to the developing cartridge for developing the latent image formed on the photosensitive drum 1.

The image forming apparatus has four developing cartridges D (Dy, Dm, Dc, Db) for development in four colors (yellow, magenta, cyan and black) to form a full-color image. The developing cartridges D, as shown in FIGS. 1 and 2, are demountably mounted on a rotary unit 11 which is rotatable about a shaft 10. In the image formation operation, each developing cartridge D is revolved while being supported on the rotary unit 11, about the shaft 10. A developing cartridge D accommodating predetermined color toner is stopped at a development position facing the photosensitive drum 1. The developing roller which will be described hereinafter is positioned with a small clearance relative to the photosensitive drum 1 (approximately 300 pm), and then the toner is supplied to the electrostatic latent image on the photosensitive drum 1 to develop the latent image.

During color image formation, the rotary unit 11 is rotated for each rotation of the intermediary transfer member 4 to permit developing operations of the yellow developing cartridge Dy accommodating the yellow color toner, the magenta developing cartridge Dm accommodating the magenta color toner, the cyan developing cartridge Dc accommodating the cyan color toner, and the black developing cartridge Db accommodating the black color toner, in this order.

FIG. 3 shows a developing cartridge D (yellow developing cartridge Dy, for example) placed at the development position faced to the photosensitive drum 1. The developing cartridge D comprises a developing roller 12 as a toner carrying member for supplying the toner to the photosensitive drum 1, and a toner accommodating portion 13*a* for accommodating the toner to be supplied to the developing roller 12. It further comprises a frame 13 for supporting the developing roller 12, and a shutter 14 for an opening provided in the frame 13 to expose the developing roller 12. Furthermore, it comprises a toner feeding member 15 in the toner accommodating portion 13*a*. A fresh developing cartridge is provided with a toner seal 30 for preventing leakage of the toner accommodated in the toner accommodating portion 13*a*. A user pulls out the toner seal 30 prior to the mounting of the fresh developing cartridge to the main assembly of the apparatus to open the toner accommodating portion 13*a*. By this, the toner in the toner accommodating portion 13*a* is permitted to be supplied to the developing roller 12.

The toner feeding member 15 is rotated by the driving force from the main assembly of the apparatus to feed the toner from the accommodating portion 13*a* to the developing roller 12. The developing roller 12 is a rotatable aluminum roller, and a development blade 16 is press-contacted to the peripheral surface of the developing roller 12. By this, when the developing roller 12 is rotated in the counterclockwise direction in FIG. 3, the toner is applied on the peripheral surface as a thin layer, and the-toner is supplied with electric charge (triboelectric charge).

The developing roller 12 facing the photosensitive drum 1 having a latent image, is supplied with a developing bias, so that a toner image is formed on the photosensitive drum 1 in accordance with the latent image.

The above-described structure and the developing process are the same in the yellow developing cartridge Dy, the magenta developing cartridge Dm, the cyan developing cartridge Dc and the black developing cartridge Db. The developing roller 12 of each developing cartridge D is connected with the driving source and high voltage generating source for each color development provided in the main assembly of the image forming apparatus when the developing cartridge D is moved to a development position, so that a developing bias voltage for each developing cartridge D is sequentially applied thereto, and the driving force is transmitted to rotate the developing roller 12 or the like.

A description will be provided as to the structure for mounting the developing cartridge D to the main assembly 30 of the image formation device. As shown in FIGS. 1 to 4, at a predetermined position of the main assembly 30 of the image forming apparatus, an insertion opening 17 having a width not less than the longitudinal direction length of the developing cartridge D, is formed, and a cover 18 is openable mounted in the insertion opening 17. The insertion opening 17 is normally closed by a cover 18.

The main assembly of the apparatus 30 is provided with a developing device exchange switch (unshown). When the developing cartridge D is exchanged after the toner therein is consumed, the user actuates the switch. Then, the rotary unit 11 rotates to bring the developing cartridge to be replaced to the position of the insertion opening 17.

When the user opened the cover 18, guides 19 constituting the mounting means for the developing cartridge D are provided at four positions of the rotary unit 11 in the main assembly 30 of the image forming apparatus. On the other hand, the shutter 14 of the developing cartridge D is provided with guide portions 20 as shown in FIGS. 5 to 10. By inserting the cartridge so that guide portion 20 is guided along the guide 19, the developing cartridge D is inserted into the main assembly 30 of the image forming apparatus. The guide 19 and the guide portion 20 are extended in the longitudinal direction (the direction of the rotation axial direction) of the developing cartridge D at both sides (only one side is shown in FIGS. 4 and 5).

After the developing cartridge D is inserted into the main assembly of the apparatus in a direction crossing with the longitudinal direction of the developing roller 12 in this manner, the user rotates the developing cartridge D, The shutter 14 is opened, and the developing roller 12 faces the photosensitive drum 1 exposed through the frame 13, so that the developing operation is enabled.

In this example, the rotary unit 11 as the mounting member carries the black developing cartridge Db for developing the latent image using the black color toner, the yellow developing cartridge Dy for developing the latent image using yellow color toner, the magenta developing cartridge Dm for developing the latent image using the magenta color toner, and the cyan developing cartridge Dc for developing the latent image using the cyan color toner.

The structures of the guide 19 and the shutter 14 will be described.

Figure 6:
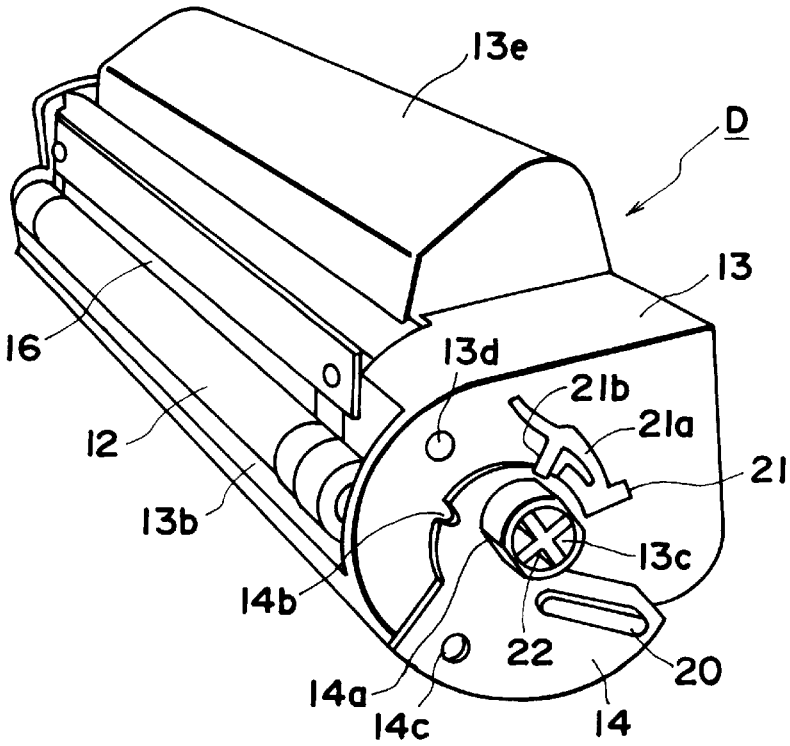
FIG. 6 is a perspective view of a developing cartridge when the shutter is opened.
Figure 7:
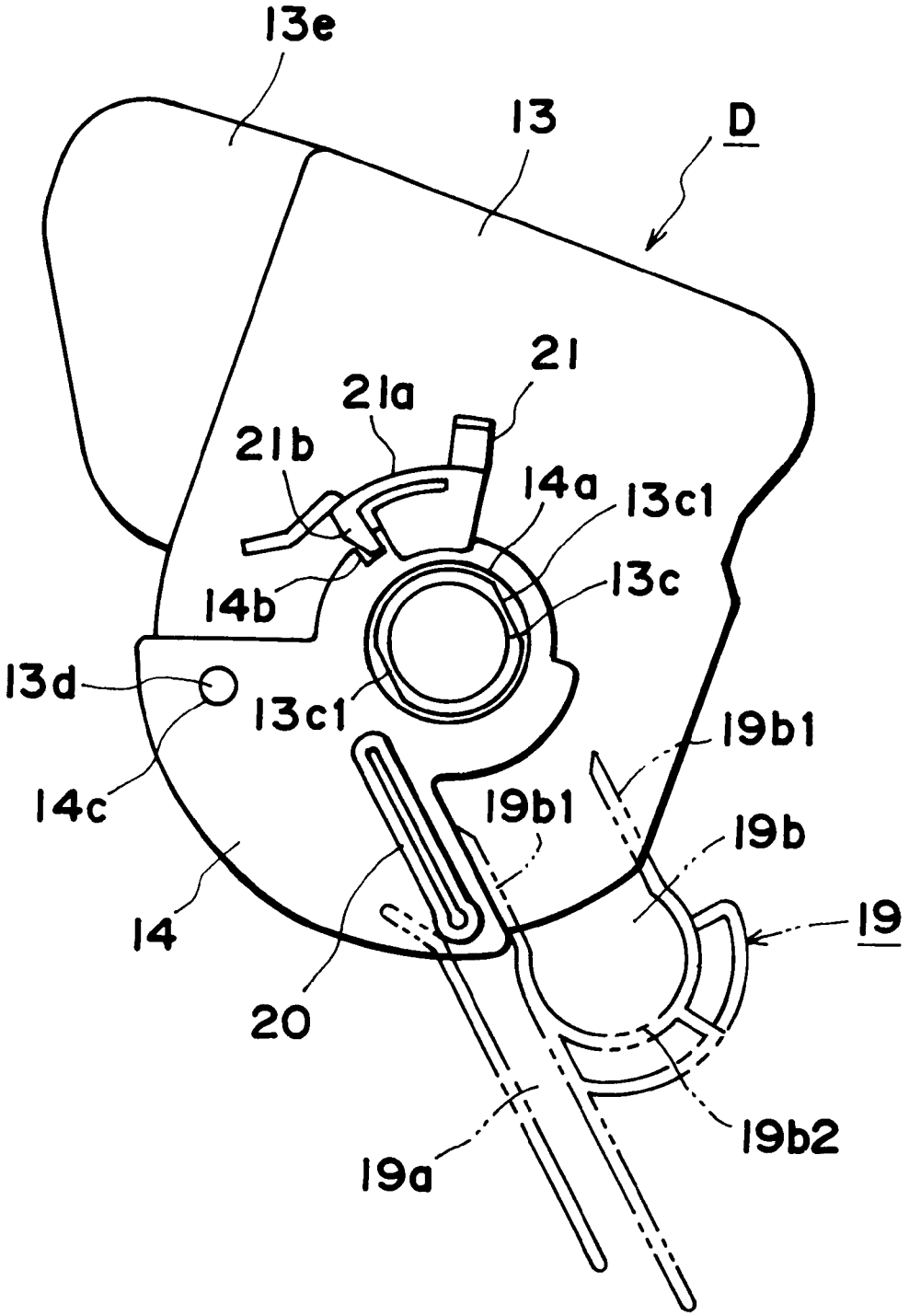
FIG. 7 is an illustration of a developing cartridge when it is inserted into a main assembly.

As shown in FIG. 6, the frame 13 of the developing cartridge D is provided with an opening 13*b* extending in the longitudinal direction, and the developing roller 12 is mounted on the frame 13 so as to be exposed through the opening 13*b*. Substantially at a central portion of each longitudinal end side of the frame 13, a projected portion 13*c* integral with the frame 13 is formed. The projected portion 13*c* functions as a guide when the developing cartridge D is inserted into the main assembly 30 of the image forming apparatus and as a center of rotation for the developing cartridge D. At least one of the projected portions 13*c* is cylindrical.

In both side walls of the shutter 14, round holes 14*a* are formed, and by engaging the projected portion 13*c* with the round hole 14*a*, the shutter 14 is rotatably mounted on the frame 13. As shown in FIG. 5, when the shutter 14 is closed, the opening 13 is closed so that developing roller 12 is covered by the shutter 14. When the developing cartridge D is out of the main assembly of the apparatus 30, the shutter 14 is closed, so that developing roller 12 is protected from deposition of foreign matter such as dust, and the roller 12 or the like is protected from damage.

Adjacent to the projected portion 13*c* of the frame 13, there is provided a locking member 21 for locking the shutter 14 in the closed state. The locking member 21 has an engaging portion 21*b* in an arm portion 21*a* as a supporting portion having elastic. On the other hand, a shutter engagement recess 14*b* as an engaging portion is provided at a predetermined position of the shutter side wall.

By this, as shown in FIG. 5, when the shutter 14 is in the closed position, the engaging portion 21*b* is engaged with the engagement recess 14*b* so that shutter 14 is locked in the closed state, thus preventing unintended opening thereof.

When the developing cartridge D is mounted on the main assembly 30 of the image forming apparatus, the locking is automatically released to permit the opening of the shutter 14, This will be described in more detail.

As shown in FIGS. 4–7, the guide 19 provided on the inner wall of the rotary unit 11, comprises two guiding member inserting portions 19*a* which are substantially parallel with each other, and a projection inserting portion 19*b* comprising a linear rib 19*b*1 and an arcuate rib 19*b*2. When the developing cartridge D is inserted into the main assembly of the apparatus, the user causes the guide portion 20 of the shutter 14 to be guided by the guide inserting portion 19*a*, and inserts the developing cartridge D.

Figure 8:
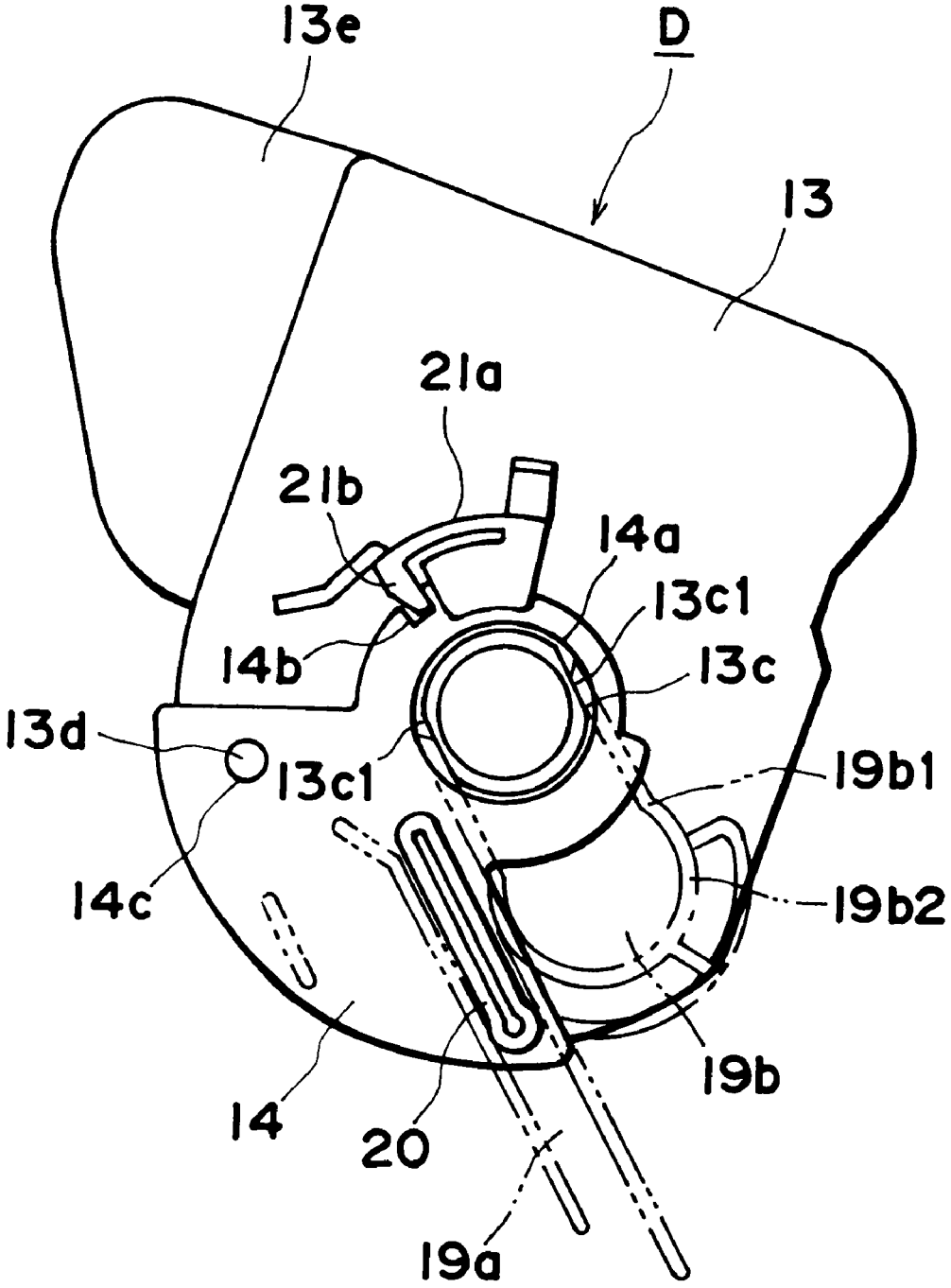
FIG. 8 is an illustration of a developing cartridge when it is inserted into a main assembly.

When the developing cartridge D is inserted, the projections 13*c* of the developing cartridge D are brought to the linear portions of the projection inserting portions 19*b*, as shown in FIG. 8. The projected portion 13*c* has cutting portions 13*c*1 which are provided by linearly cutting the cylindrical 1 portion in a direction parallel with the linear rib 19*b*1. The two linear ribs 19*b*1 engageable therewith, each have a width for permitting movement of the cutting portion 13*c*1 only in the direction parallel with the cutting portions 13*c*1. Therefore, when the developing device D is inserted into the main assembly of the apparatus 30, it is maintained at a predetermined angle (orientation) by the cutting portions 13*c*1 and the linear ribs 19*b*1.

When the projections 13*c* are inserted to the arcuate rib 19*b*2, as shown in FIG. 9, a leading end of one of the linear ribs 19*b*1 is abutted to the arm portion 21*a* which locks the shutter 14 to raise it upwardly as shown in FIG. 9. By this, the arm portion 21*a* is elastically deformed so that engaging portion 21*b* is releasable from the engagement recess 14*b*, and therefore, the locking of the shutter 14 is released (namely, in this embodiment, the linear rib 19*b*1 is a releasing means for the locking member 21). With this state, the shutter 14 is in a rotatable state relative to the development cartridge frame 13. The arcuate rib 19*b*2 has a radius for permitting rotation of the cylindrical projected portion 13*c*, and the developing cartridge D is in a rotatable state about the cylindrical projected portion 13*c*.

At both longitudinal ends of the developing cartridge frame 13, projections 13*d*, which are semispherical engaging portions, are provided as shown in FIG. 9, and correspondingly, the shutter 14 has holes 14*c* which are to be engaged with the projections 13*d*. Therefore, when the shutter 14 is closed, the projections 13*d* are engaged with the holes 14*c*. So, even if the locking by the locking member 21 of the shutter 14 is released, the developing cartridge frame 13 is prevented from rotating to an unstable position relative to the shutter 14.

Subsequently, as shown in FIG. 10, the user presses the grip portion 13*e* of the frame 13. At this time, the cylindrical projected portion 13*c* of the frame 13 is rotatable in the arcuate rib 19*b*2 although the shutter 14 is not, because the guide portion 20 is sandwiched by the guide portion inserting portion 19*a*. Therefore, the semi-spherical projection 13*d* rotates to the predetermined position beyond the hole 14*c* of the shutter 14 (x direction in FIG. 10). Since the shutter 14 is provided with the insertion guide portion 20, the frame 13 is easily rotated while the shutter 14 is in the fixed state. When it is rotated to a predetermined position, the frame 13 is positioned by a positioning means (unshown), so that developing cartridge D is mounted in place.

By this, the shutter 14 is opened to expose and face the developing roller 12 to the photosensitive drum 1. During this mounting operation, the user can feel the rotation start position for the developing cartridge D on the basis of the click feeling provided by the removal of the semi-spherical projection 13*d* from the hole 14*c* of the shutter 14.

The diameter of the arcuate portion of the projected portion 13*c* is larger than the distance between the cutting portions 13*c*1, and therefore, the projected portion 13*c* is not disengaged from the linear rib 19*b*1 when the projected portion 13*c* is rotated at the position of the arcuate rib 19*b*2.

On the other hand, when the developing cartridge D is removed from the main assembly 30 of the image forming apparatus, the user rotates the frame 13 in the direction opposite from the foregoing, the cutting portions 13*c*1 become parallel with the linear rib 19*b*1, and the shutter 14 is closed. The user can feel the rotation completion position of the developing cartridge D on the basis of the click feeling upon the engagement of the semi-spherical projection 13*d* into the hole 14*c*. When the developing cartridge D is pulled out of the main assembly of the apparatus 30, the situation is as shown in FIG. 8, so that arm portion 21*a* of the locking member 21 elastically restores to engage the locking portion 21*b* into the engagement recess 14*b*. By this, the shutter 14 is automatically locked.

By the provision of the shutter 14 in the developing cartridge D, the developing roller 12 is prevented from being contaminated by dust or the like. Since the shutter 14 is provided with a locking mechanism, the shutter 14 is prevented from inadvertent opening.

When the developing device is inserted into the main assembly 30 of image forming apparatus, the shutter 14 maintains its closed state, and therefore, the developing roller 12 is not damaged during insertion. In addition, the user is not required to remove the developing roller protection member by his hands before insertion of the developing cartridge as in a conventional system.

Furthermore, the shutter locking is automatically released when the developing cartridge is mounted to the main assembly 30 of the image forming apparatus, and only by rotation thereof after the insertion, the shutter 14 is released, and the developing roller 12 is faced to the photosensitive drum 1, thus completing the mounting operation. Thus, mounting operativity is improved.

A description will be provided as to a drive transmission structure from the main assembly of the apparatus to the developing cartridge D.

As shown in as shown in FIGS. 11 and 12, a driving force receptor 22 for receiving a driving force from the main assembly of the apparatus 30 to rotate the developing roller 12, is provided in one of the cylindrical projected portions 13*c* at one of the frame ends. The gear 23*a* meshes with a roller gear 23*b* mounted on the rotation shaft of the developing roller 12. When the driving force is transmitted to the receptor 22, the developing roller 12 rotates. The gear 23*a* is meshed also with the gear 23*b* mounted on the rotation shaft of the toner feeding member 15 through a gear 23*c* to transmit the rotating force to the toner feeding member 15.

The end of the driving force receptor 22 is in the form of a rib, which constitutes a coupling connectable with a drive transmission member of the main assembly of the apparatus.

On the other hand, the rotary unit 11 in the main assembly 30 of the image forming apparatus, is provided with a drive transmission member 24 for transmitting the driving force from a motor N, on the shaft facing the driving force receptor 22 when the developing cartridge D is mounted in place. The transmitting mechanism for transmitting the driving force to the drive transmission member 24 from the motor M, is schematically shown by chain lines. The drive transmission member 24, as shown in FIG. 11, is mounted for movement toward the shaft of the driving force receptor portion 22, and the end thereof is formed into a coupling engageable with the rib of the driving force receptor. The coupling has any shape by which when the drive transmission member 24 is moved to the receptor 22, they are engaged, and when one rotates the other rotates. In this example, the receptor 22 has a plurality of recesses 22*e*, and the drive transmission member 24 is provided with a plurality of projections 24*a*, correspondingly. By rotation of the drive transmission member 24 while the meshing engagement between the recess 22*a* and the projection 24*a* is maintained, the driving force receptor portion 22 is rotated.

When the developing cartridge D is moved by rotation of the rotary unit 11 in the image formation, the drive transmission member 24 is moved toward the receptor 22 by a moving mechanism (unshown), and is engaged therewith to permit transmission of driving force to the developing roller 12 or the like. By this structure, even if the stop position of the developing cartridge D relative to the photosensitive drum 1 is more or less deviated, or even if the generating lines of the photosensitive drum 1 and the rotary unit 11, are more or less deviated, the driving force transmission to the developing cartridge D is properly transmitted from the same position, and only the driving torque is transmitted, so that the influence of the meshing off-set between gears due to pitch nonuniformity or the like can be reduced.

(Second Embodiment)

Figure 13:
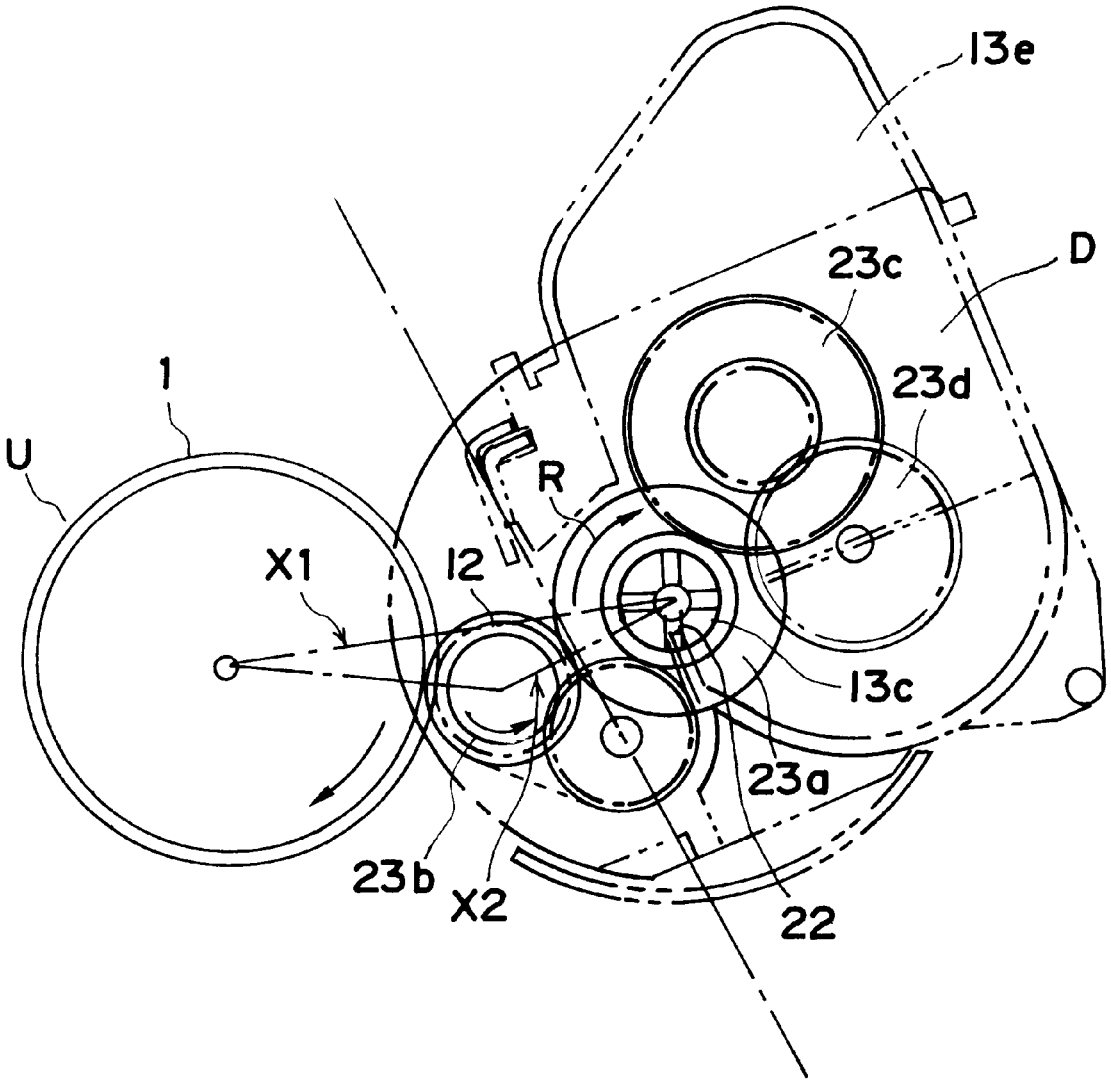
FIG. 13 is an illustration of a structure for stabilizing the pressure of a developing roller relative to a photosensitive drum.
Figure 14:
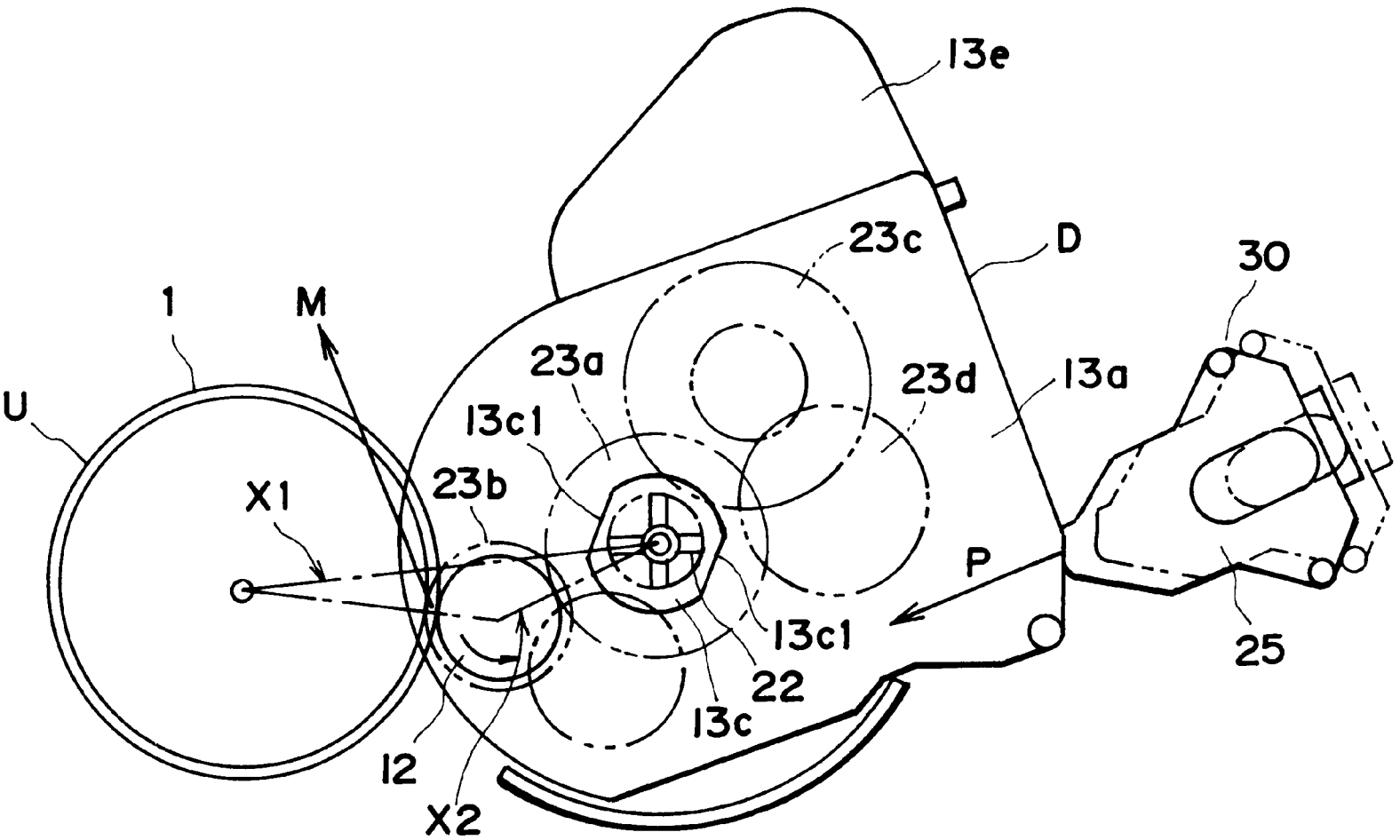
FIG. 14 is an illustration of a structure for stabilizing the pressure of a developing roller relative to a photosensitive drum.

Referring to FIGS. 13 and 14, a description will be provided as to a structure for stabilizing the pressure of the developing roller 12 to the photosensitive drum 1, according to a second embodiment of the present invention. The same reference numerals as in Embodiment 1 are assigned to the elements having the corresponding functions, and detailed descriptions thereof are omitted for simplicity.

As described in the first embodiment, the developing cartridge D receives the rotating force at the driving force receptor from the drive transmission member 24 of the main assembly 30 of the image forming apparatus at the development position.

As shown in FIG. 13, a line X1 is defined as a line connecting a rotation center of the developing cartridge D about the projected portion 13*c* and the center of rotation of the photosensitive drum 1, and a line X2 is defined as a line connecting the rotation center of the projected portion 13*c* and the center of rotation of the developing roller 12. When the developing cartridge D is at the development position, the line X2 is located upstream of the line X1 with respect to the driving rotational direction R toward the driving force receptor 22, as seen from the rotation center of the projected portion 13*c*.

By this structure, the developing roller 12 receives normally the force to bite into the photosensitive drum 1, so that developing roller 12 is stably urged toward the photosensitive drum 1 normally. This is advantageous in so-called contact development, but it particularly advantageous in non-contact development since the gap is stabilized.

As shown in FIG. 14, consideration will be made as to the case where an urging means is provided to fix the developing cartridge while urging it toward the photosensitive drum 1 when the developing cartridge is at the development position. When M is a direction of the moment produced in the developing cartridge D by the urging direction P of the urging means, designated by X1 is a line connecting the center of rotation of the developing cartridge D provided by the projected portion 13*c* and the center of rotation of the photosensitive drum 1, designated by X2 is a line connecting the rotation center of the projected portion 13*c* and the center of rotation of the developing roller 12; and the line X2 is located upstream of the line X1 with respect to the moment direction M as seen from the rotation center of the projected portion 13*c*. The same effects are provided with this structure, too. The urging means urges the rear surface portion adjacent the toner accommodating portion 130 at each of the longitudinal ends of the developing cartridge D.

(Third Embodiment)

Referring to FIGS. 15 to 24, another embodiment of the developing cartridge D will be described. In this embodiment, the developing cartridge D is demountably mountable relative to the full-color laser beam printer shown in FIG. 1.

Also, the developing cartridge D comprises a developing roller 12, a development blade 16 and toner accommodating portion 63*a* in the cartridge frame 63.

Figure 15:
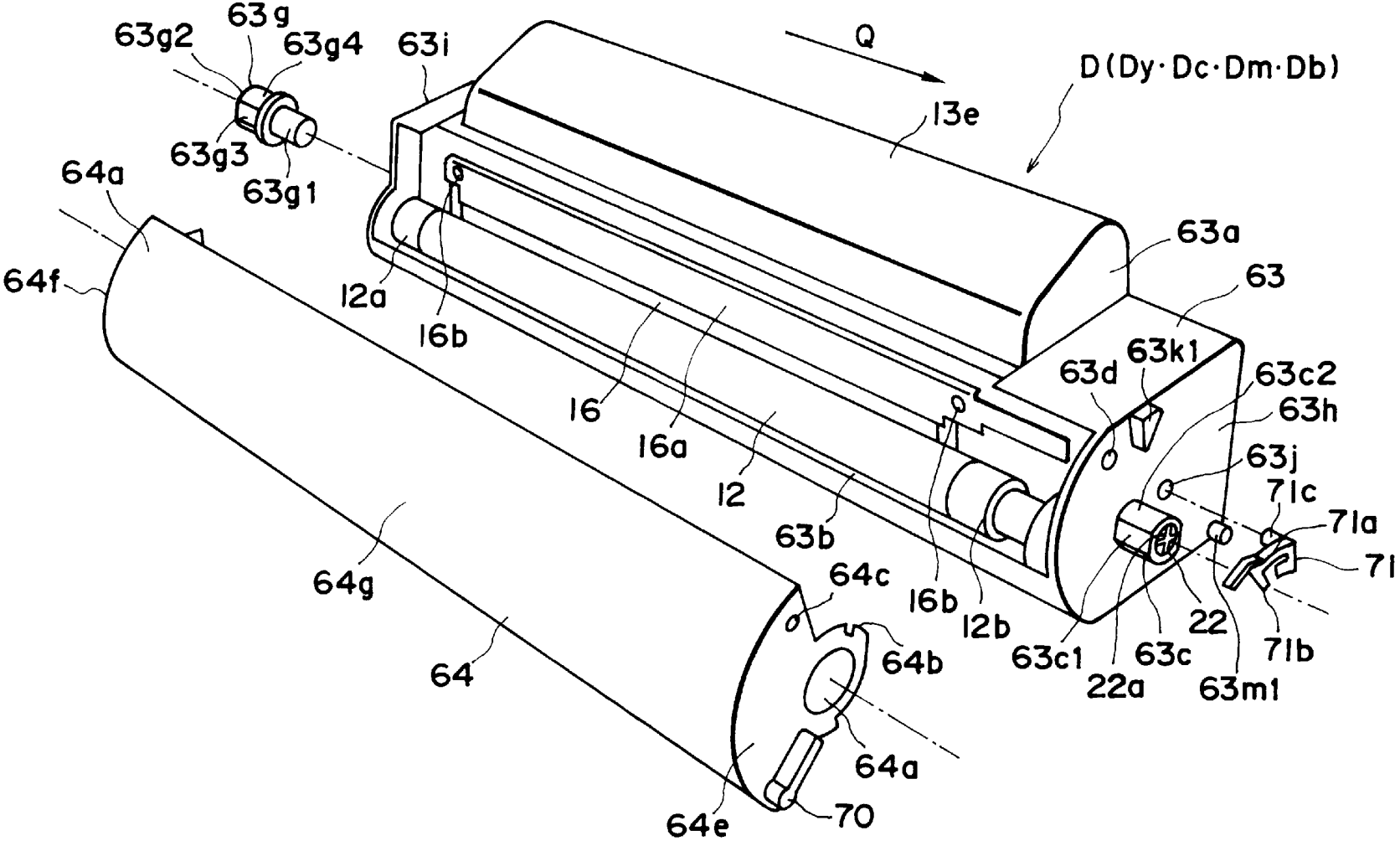
FIG. 15 is an exploded perspective view of a developing cartridge according to another embodiment of the present invention.
Figure 17B:
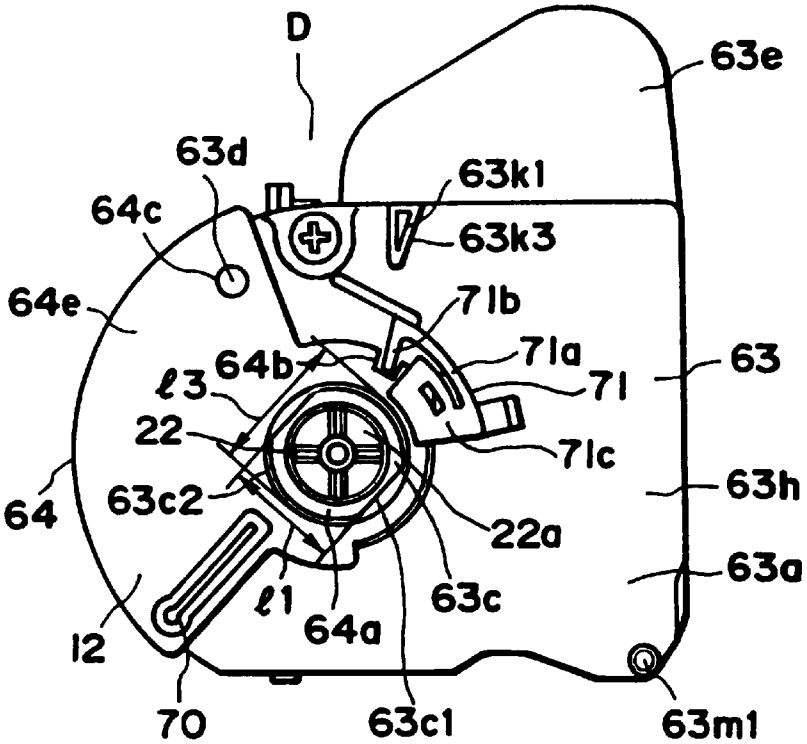
FIG. 17, (a), is a side view of the other end of the developing cartridge shown in FIG. 15 (shutter is closed), and (b) is a side view of one end of a developing cartridge shown in FIG. 15 (shutter is closed).
Figure 17A:
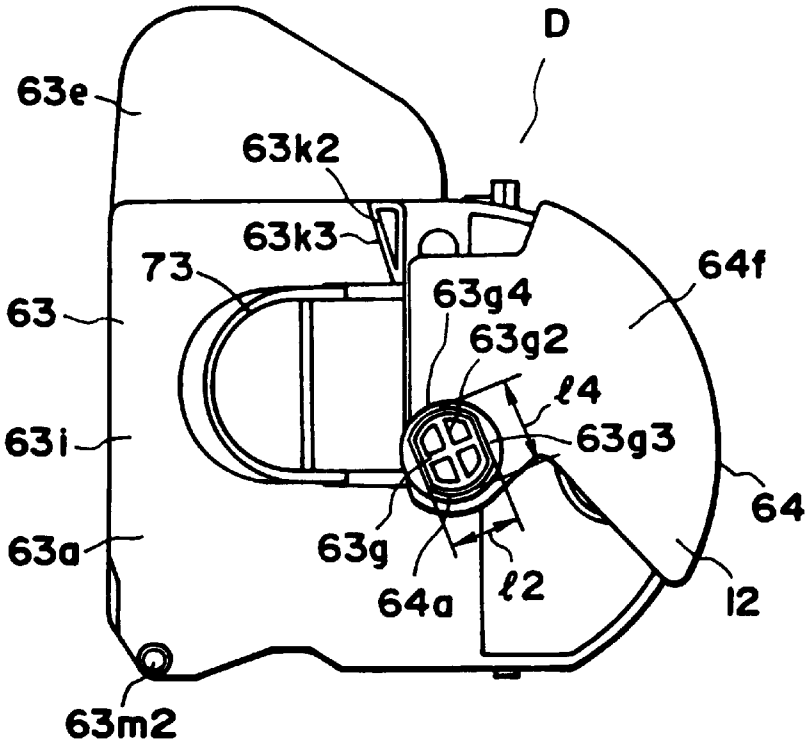
Figure 18B:
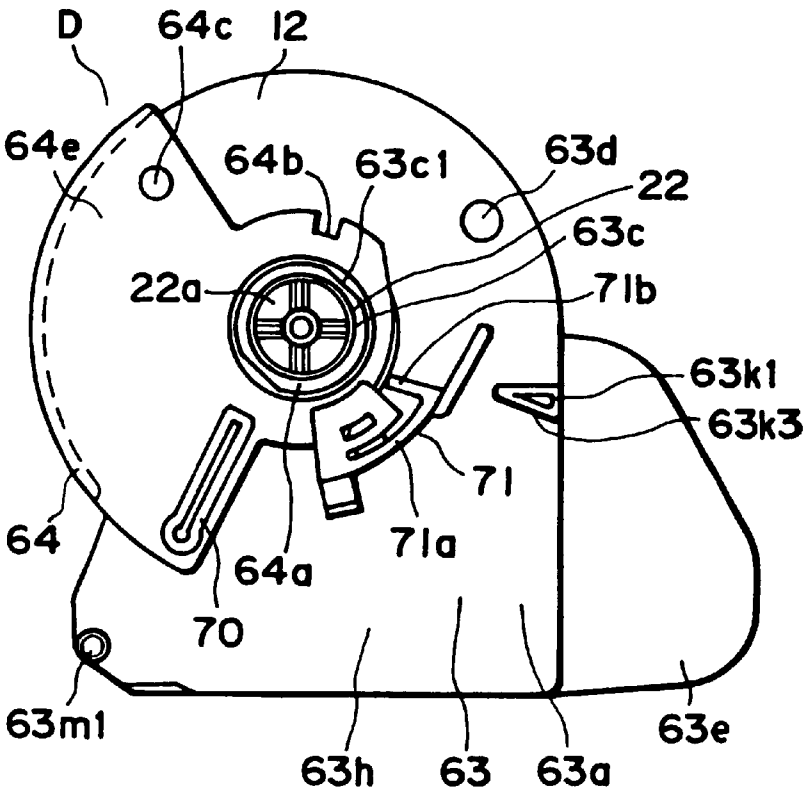
FIG. 18, (a), is a side view of the other end of the developing cartridge shown in FIG. 15 (shutter is open), and (b) is a side view of one end of a developing cartridge shown in FIG. 15 (shutter is open).
Figure 18A:
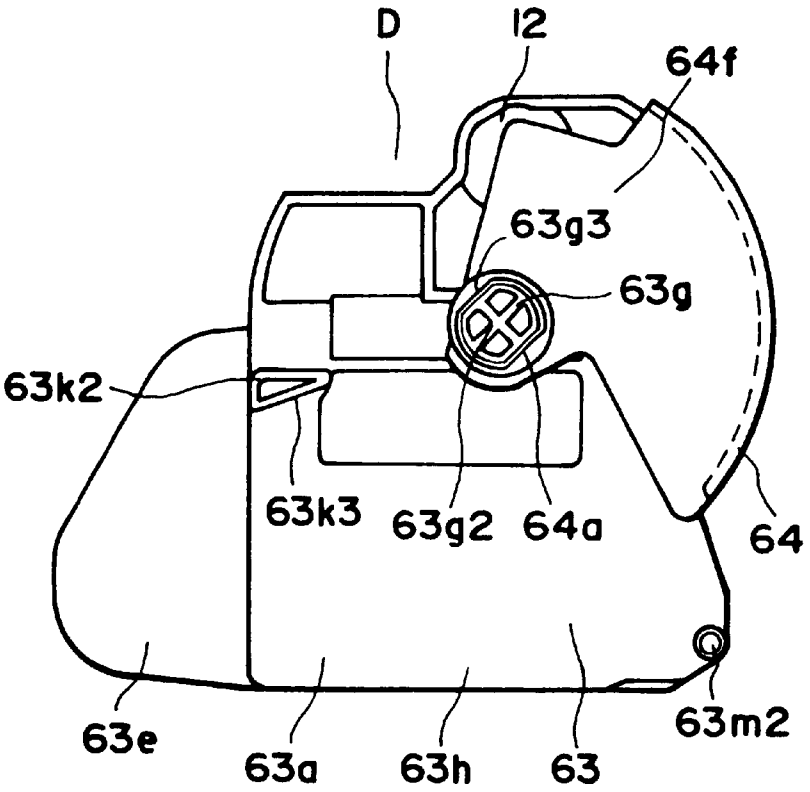

When the user opens the cover 18, guides 59 constituting mounting means for the developing cartridge D are provided at four positions 4 of the rotary unit 11 in the main assembly 30 of the image forming apparatus. On the other hand, the shutter 64 of the developing cartridge D is provided with a guide portion 70, as shown in FIGS. 15, 17 and FIG. 18. By inserting the cartridge so that guide portion 70 is guided along the guide 19, the developing cartridge D is inserted into the main assembly 30 of the image forming apparatus. The guide portion 70 is provided only on one side (in the longitudinal direction or the rotation axial direction of the developing roller 12) of the developing cartridge D. Therefore, the guide 59 is also provided only on one of the wall surfaces 11*a* of the rotary unit 11.

The developing cartridge D is inserted to the rotary unit 11 in a direction crossing with the longitudinal direction of the developing roller 12 with the developing roller 12 being at a leading side, while the user grips the grip 63*e*.

After the developing cartridge D is inserted to the main assembly of the apparatus 30, the user rotates the developing cartridge D, by which the shutter 64 is opened to permit the developing roller 12 to be exposed and faces the frame 63 to the photosensitive drum 1, thus enabling the developing operation.

The developing cartridge D mounted to the mounting position of the rotary unit 11 is urged in the longitudinal direction by a spherical urging member 26*b* positioned at the arcuate engaging portion 26*a* of the guide 26 provided on the other wall surface 11*b* of the rotary unit 11 (namely, urged to the side having the driving force receptor 22). The urging member 26*b* is urged elastically by a spring (unshown). The developing cartridge D is urged toward the driving side. Therefore, the developing cartridge D is mounted to the rotary unit 11 (main assembly of the apparatus), using as a reference the side having the driving force receptor member 22 in the longitudinal direction of the developing roller 12.

Figure 16:
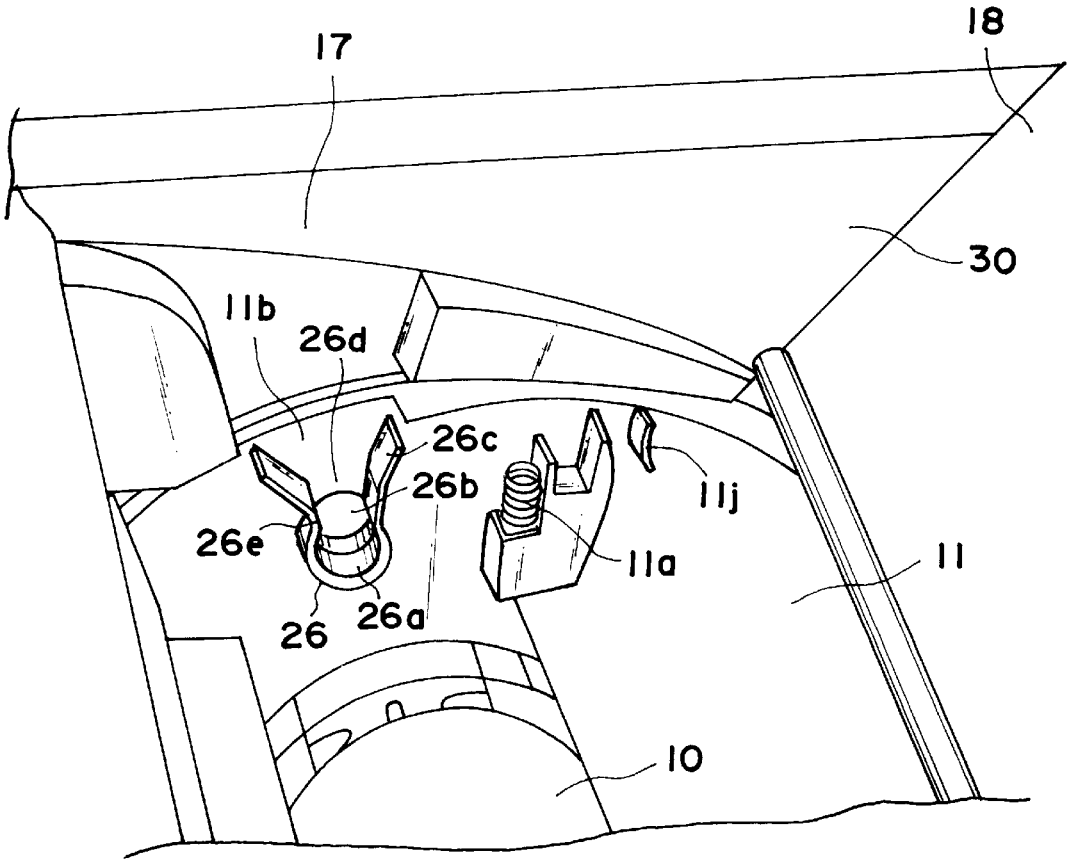
FIG. 16 is a perspective view of a guide portion provided in the main assembly of the apparatus.

The developing cartridge D will be described in more detail, referring to FIGS. 15, 17, (a), (b), and FIG. 18, (a) and (b), FIG. 16 is a perspective view of the developing cartridge D wherein shutter 64 or the like is omitted. FIG. 17, (a), (b), are both side views of the developing cartridge D when the shutter 64 is closed, and FIGS. 18, (a), (b), are both side views of the developing cartridge when the shutter 64 is opened.

As shown in FIG. 15, the frame 63 of the developing cartridge D is provided with an opening 63*b* extended in the longitudinal direction, and the developing roller 12 is mounted on the frame 63 so as to be exposed through the opening 63*b*. Substantially at a central portion of one longitudinal direction end side 63*h* of the frame 63, a projected portion 63*c* integral with the frame 13 is formed. The projected portion 63*c* functions as a guide when the developing cartridge D is inserted into the main assembly 30 of the image forming apparatus and as a center of rotation for the developing cartridge D. The projected portion 63*c* is cylindrical.

At substantially the central portion of the other side of the frame 63, a projected portion 63*g* is demountably mounted on the frame 63 (frame 63 shows the demounted state). The projected portion 63*g* is mounted to the frame 63 by inserting the inserting portion 63*g*1 into a hole (unshown) formed in the side 63*i*. The end of the inserting portion 63*g*1 is provided with a claw configuration portion (unshown), and by engaging the claw portion with the frame 63, projected portion 63*g* is mounted on the frame 63. When the developing cartridge D is mounted to the mounting position of the rotary unit 11, the end surface 63*g*2 of the projected portion 63*g* is urged to the member 26*b*. Therefore, the developing cartridges D is urged toward the side 63*h* (in the direction indicated by the arrow Q). The developing cartridge D is mounted to the rotary unit 11 of the main assembly of the apparatus 30, using, as a reference, the side 63*h* of the driving force receptor member 22.

Both of the longitudinal ends of the developing roller 12 are provided with spacer rollers 12*a*, 12*b*, respectively. Therefore, at the development position, the spacer rollers 12*a*, 12*b* are urged to the peripheral surface of the photosensitive drum 1 by the urging force of the urging means 25, similarly to the foregoing, so that a predetermined gap is maintained between the developing roller 12 and the photosensitive drum 1.

The developing blade 16 is of rubber, and is mounted to the frame 63 by mounting a plate 16a to the frame with screws 16*b*.

A locking member 71 is mounted to one side of the developing cartridge D (in FIG. 16, it is omitted). The locking member 71 is mounted on a cartridge frame portion 63*h* at one longitudinal end portion of the developing roller 12 as the developing means. It comprises a locking engaging portion 71*b* engageable with the shutter engaging portion 64*b* provided in the shutter portion 64, a supporting portion 71*a* for supporting the locking engaging portion 71*b*, and a mounting portion 71*c* mounted to the cartridge frame portion 63*h*. Designated by 63*j* is a hole into which the mounting portion is inserted. The locking member 71 is an integrally-molded product of plastic resin material, and locks the shutter at the closing position by engagement between the locking engaging portion 71*h* and the shutter engaging portion 64*b*. In the process of mounting the developing cartridge D to the mounting position of the main assembly of the apparatus 30, a part of the locking member 71 is contacted to a fixing portion provided in the main assembly of the apparatus 30, by which the supporting portion 71*a* is elastically deformed, so that locking engaging portion 71*b* is disengaged from the shutter engaging portion 64*b* to release the locking of the shutter 64.

A projection 63*d* as a semi-spherical engaging portion is provided only on one longitudinal end of the developing cartridge frame 63, as shown in FIG. 18. Correspondingly, the shutter 64 is provided with an engaging portion in the form of a hole 64*c* engageable with the projection 63*d*. Therefore, when the shutter 64 is in the closing position, the projection 63*d* is engaged in hole 64*c*. So, even if the locking by the locking member 21 of the shutter 14 is released, the developing cartridge frame 13 is prevented from rotating to an unstable position relative to the shutter 14.

One and the other ends of the cartridge frame 63 are provided with an orientation determination boss 63*m* and a spring receptor portion 63*k* in the form of projections.

As shown in FIG. 17, (a), designated by 73 is a grip for pulling a toner seal out, and it is used when it is to be removed.

The shutter 64 will be described.

Both side walls 64*e*, 64*f* of the shutter 64 are provided with round holes 640*a*, which are engaged with the projected portion 63*c*, 63*g*, by which the shutter 64 is rotatably mounted to the frame 63. As shown in FIG. 17, when the shutter 64 is closed, the opening 63*b* is closed, and the developing roller 12 is covered by the shutter 64. When the developing cartridge D is out of the main assembly of the apparatus 30, the shutter 64 is closed, so that developing roller 12 is protected from deposition of foreign matter such as dust, and the roller 12 or the like is protected from damage. In addition, foreign matter does not enter the developing cartridge D. As shown in FIG. 17, when the shutter 64 is in the closing position by the locking portion 71, the shutter 64 is locked at the closing position by the locking of the engaging portion 71*b* and the engagement recess 64*b*, so that it is prevented from unintentional opening.

When the developing cartridge D is mounted on the main assembly 30 of the image forming apparatus, the locking is automatically released to permit the opening of the shutter 64.

Referring to FIG. 19–FIG. 24, a description will be provided as to a process of mounting the developing cartridge D to the main assembly of the apparatus 30, and a process of positioning the main assembly of the apparatus 30.

Figure 19:
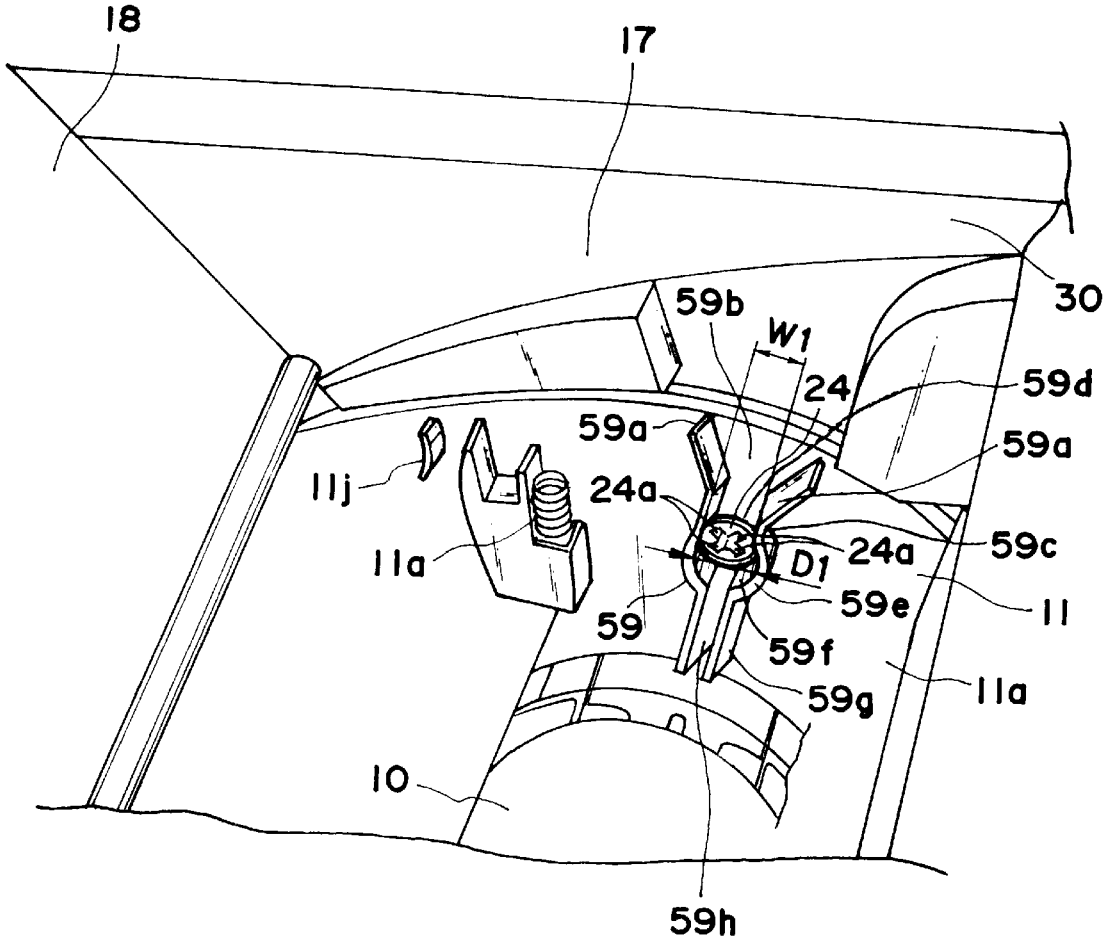
FIG. 19 is a perspective view of a guide portion in the main assembly of the apparatus.

As shown in FIG. 19, a guide 59 as a supporting member provided in one of the inner walls 11*a* of the rotary unit 11, comprises a guide inserting portion 59*b* having an inclined portion 59*a* inclined and open upwardly, a projected portion inserting portion 59*d* having substantially parallel linear ribs 59*c*, an engaging portion 59*f* as a supporting member having an arcuate rib 59*e*, and guide portion inserting portion 59*h* having substantially parallel DC ribs 59*g* continuing to the engaging portion 59*f*.

Figure 20:
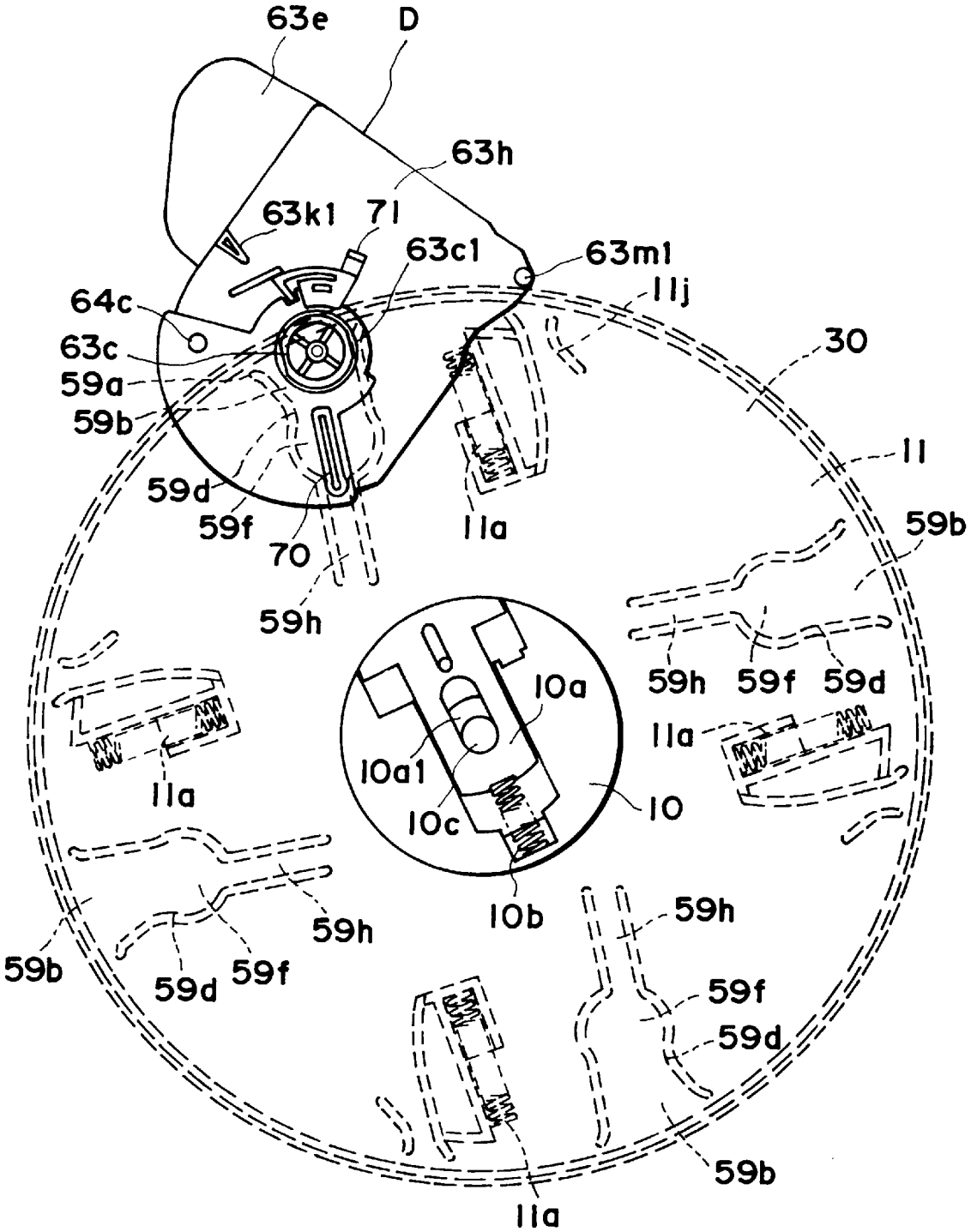
FIG. 20 is a side view showing a process of mounting a developing cartridge to a rotary unit.

When the developing cartridge D is inserted to the main assembly of the apparatus 30, the user inserts the developing cartridge D while guiding the guide portion 70 and projected portion 63*c* of the shutter 64 along the guide inserting portion 59*a* (FIG. 20).

Figure 21:
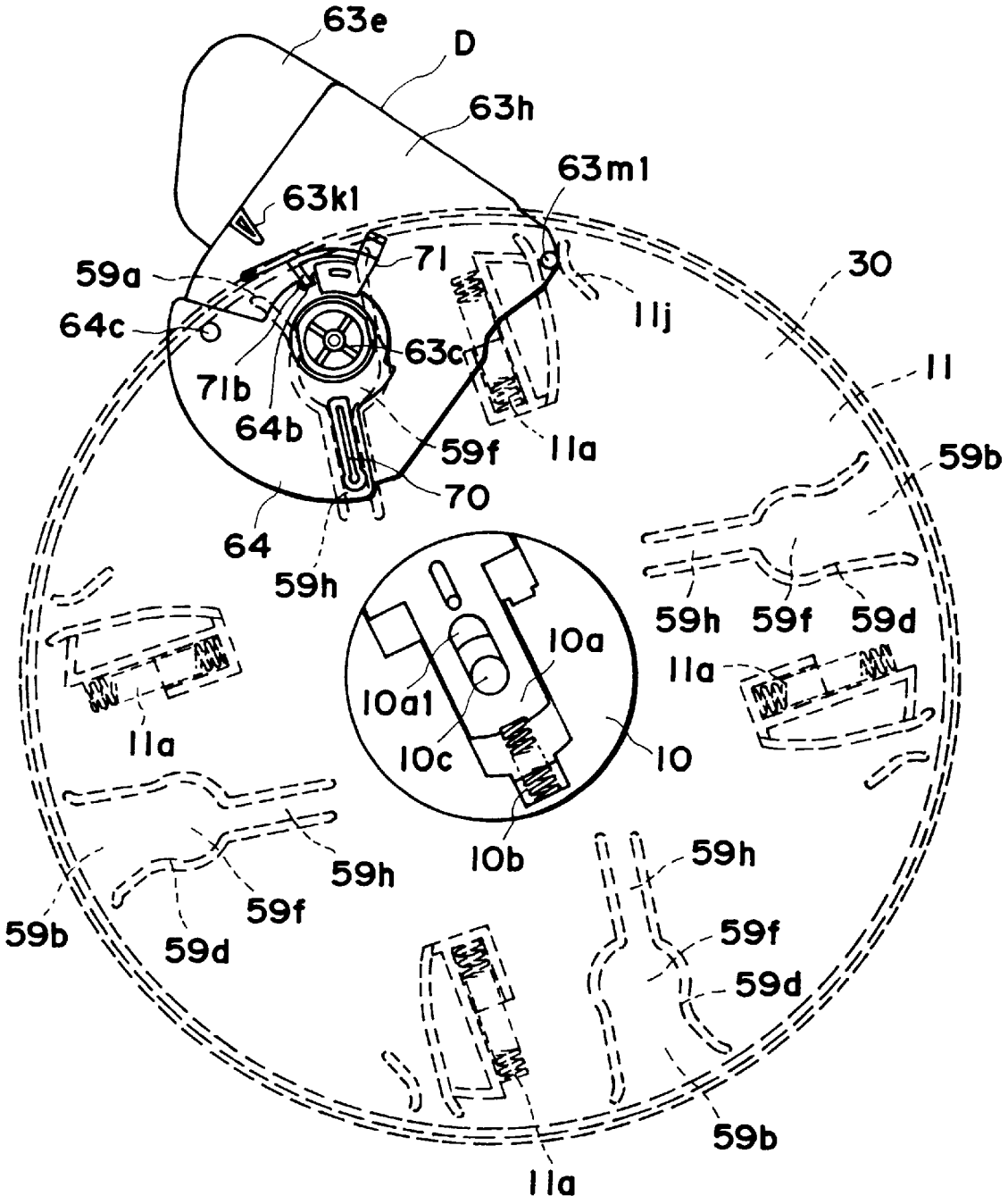
FIG. 21 is a side view showing a process of mounting a developing cartridge to a rotary unit.

When the developing cartridge D is inserted, as shown in FIG. 21, the projected portion 63*c* at one end of the developing cartridge D enters the linear portion of the projected portion inserting portion 59*d*. The projected portion 63*c* is provided with a cutting portion 63*c*1 which is provided by linearly cutting a cylinder at an angle parallel the linear rib 59*c*. The two linear ribs 59*c* which are engageable therewith have a width which permits only the parallel translational motion of the cutting portion 63*c*1 (direction W1 in FIG. 19). Therefore, when the developing cartridge D is inserted while the cutting portion 63*c*1 is engaged with the linear rib 59*c*, the developing cartridge D maintains a predetermined angle (orientation).

Figure 22:
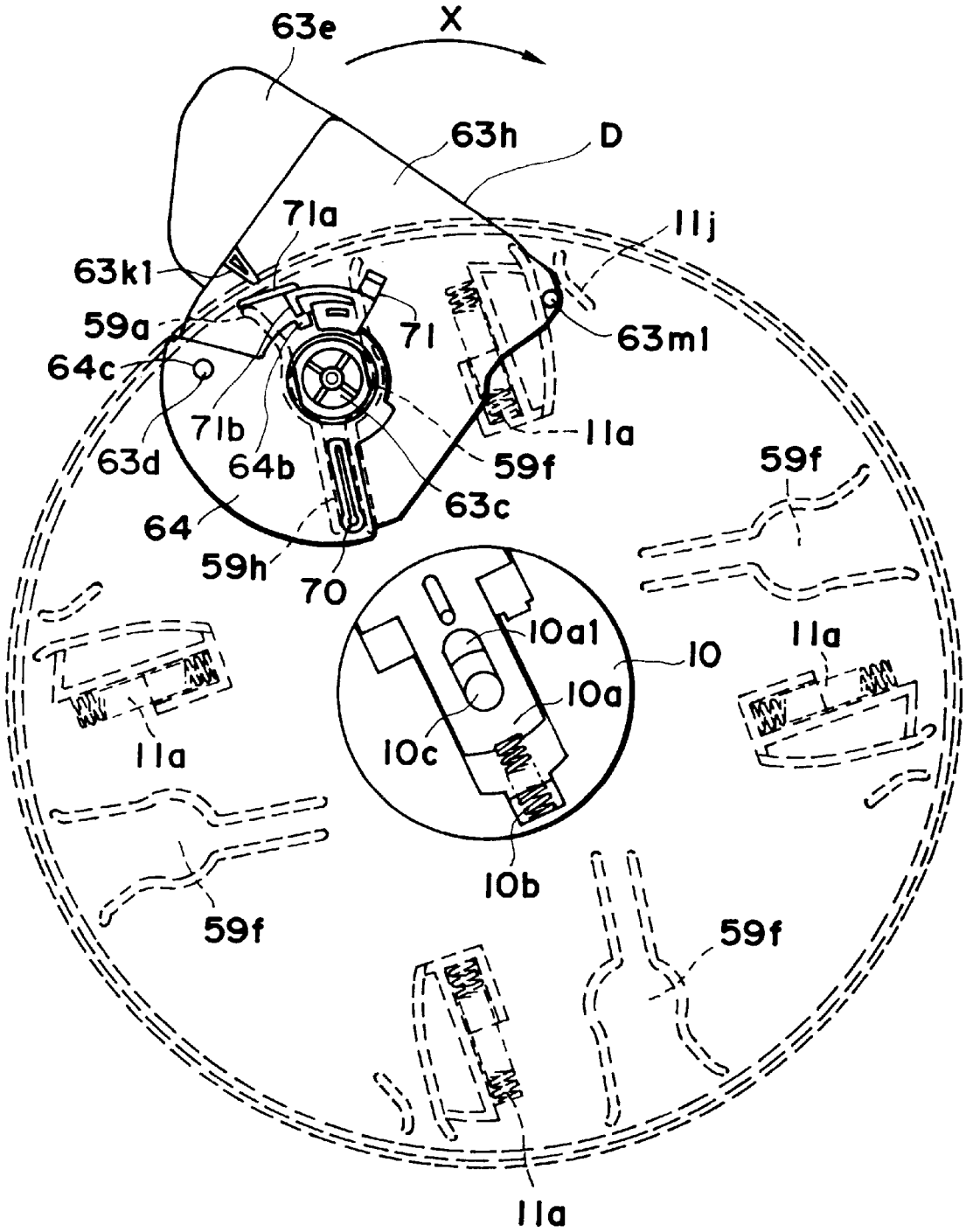
FIG. 22 is a side view showing a process of mounting a developing cartridge to a rotary unit.
Figure 23:
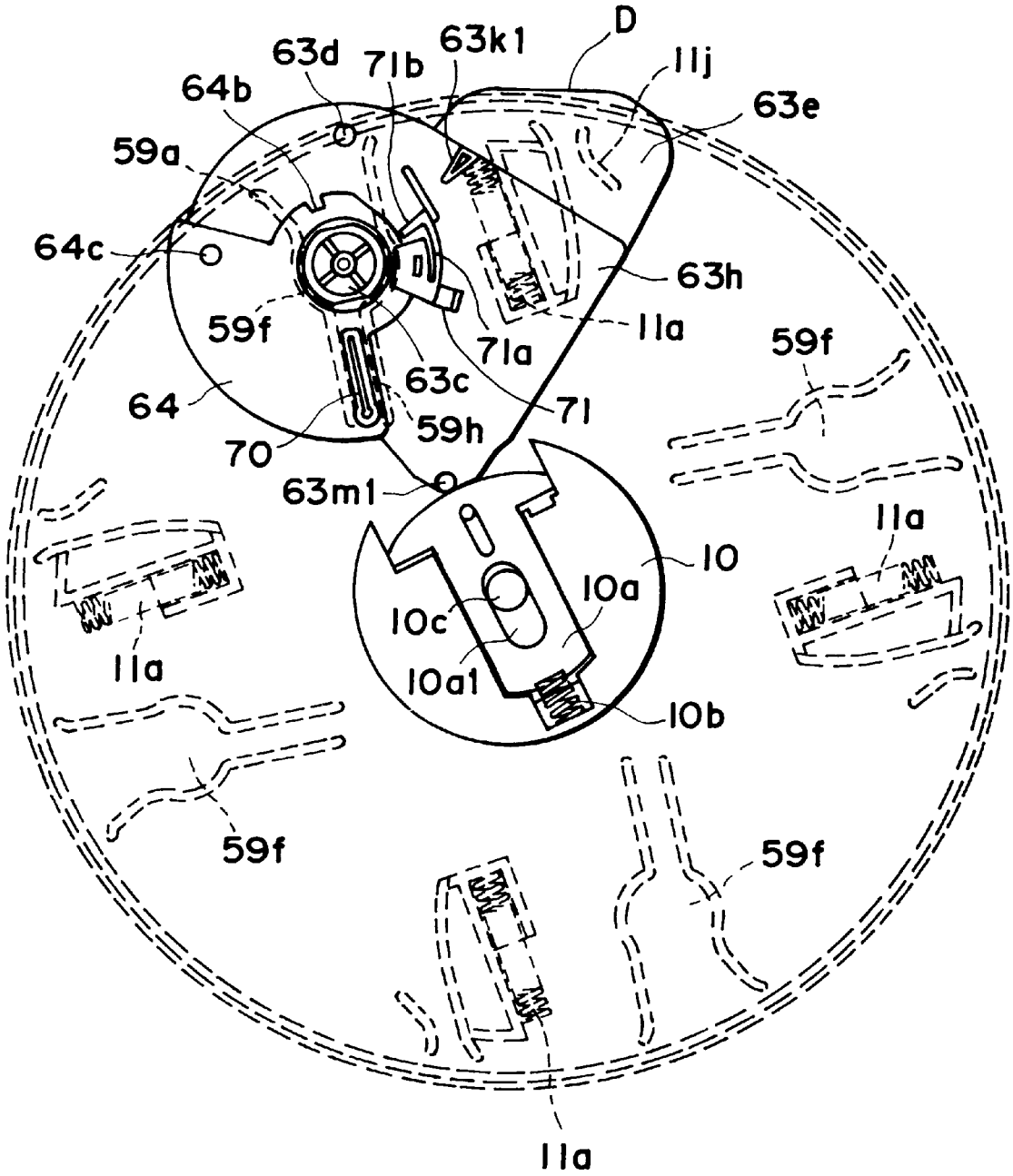
FIG. 23 is a side view showing a process of mounting a developing cartridge to a rotary unit.

As shown in FIG. 22, when the projected portion 63*c* is inserted to the arcuate rib 59*e*, an end of one of the two inclined portions 59*a*, is abutted to an arm portion 71*a* locking the shutter 64 and raises it, as shown in FIG. 22. By this, the arm portion 71*a* elastically deforms so that engaging portion 71*b* is disengaged from the engagement recess 64*b* to release the locking of shutter 64 (in this embodiment, the inclined portion 59*a* also functions to release the locking member 21). Thus, the shutter 64 becomes rotatable relative to the developing cartridge frame 63. The arcuate rib 59*e* has a radius for permitting rotation of the cylindrical projected portion 63*c*, and the developing cartridge D is in a rotatable state about the cylindrical projected portion 63*c*.

On the other hand, the projected portion 63*g* at the other side 63*i* of the developing cartridge D, is guided by the inclined portion 26*c* of the guide 26 and enters the guide inserting portion 26*d*. When the developing cartridge D is inserted further, the cutting portion 63*g*3 is engaged with the linear rib 26*e*, and the developing cartridge D is inserted, maintaining the predetermined angle (orientation), similarly to the case of the projected portion 63*c*. It is inserted until the projected portion 63*g* reaches the arcuate rib (engaging portion) 26*a*. The arcuate rib 26*a* has a radius for permitting rotation of the projected portion 63*g*. Therefore, the projected portion 63*c* of one longitudinal end of the frame 63 is supported by the arcuate rib 59*c* of the guide 59, and the projected portion 63*g* at the other end is supported by the arcuate rib 26*a* of the guide 26, and the developing cartridge D is supported on the rotary unit 11 for rotation about the both projected portions 63*c* and 63*g*.

The user pushes by hand the grip portion 63*e* of the frame 63 in the state shown in FIG. 22. The shutter 64 is fixed since the guide portion 7 is sandwiched by the guide portion inserting portion 59*h*, but the frame 63 is rotatable since the cylindrical projected portion 63*c* is rotatable in the arcuate rib 59*e*, Since the projected portion 63*g* is rotatable at the arcuate rib 26*a*, the semi-spherical projection 63*d* rotates beyond the hole 64*c* of the shutter 64 to a predetermined position (in the direction of an arrow X in FIG. 22). As described above in the foregoing, in this example, the shutter 64 is provided with an insertion guide portion 70, and therefore, the frame 63 is easily rotated while the shutter 64 is stationary. When it is rotated to the predetermined position, the frame 63 is positioned by positioning means which will be described hereinafter, and the developing cartridge D is mounted in place.

Figure 24:
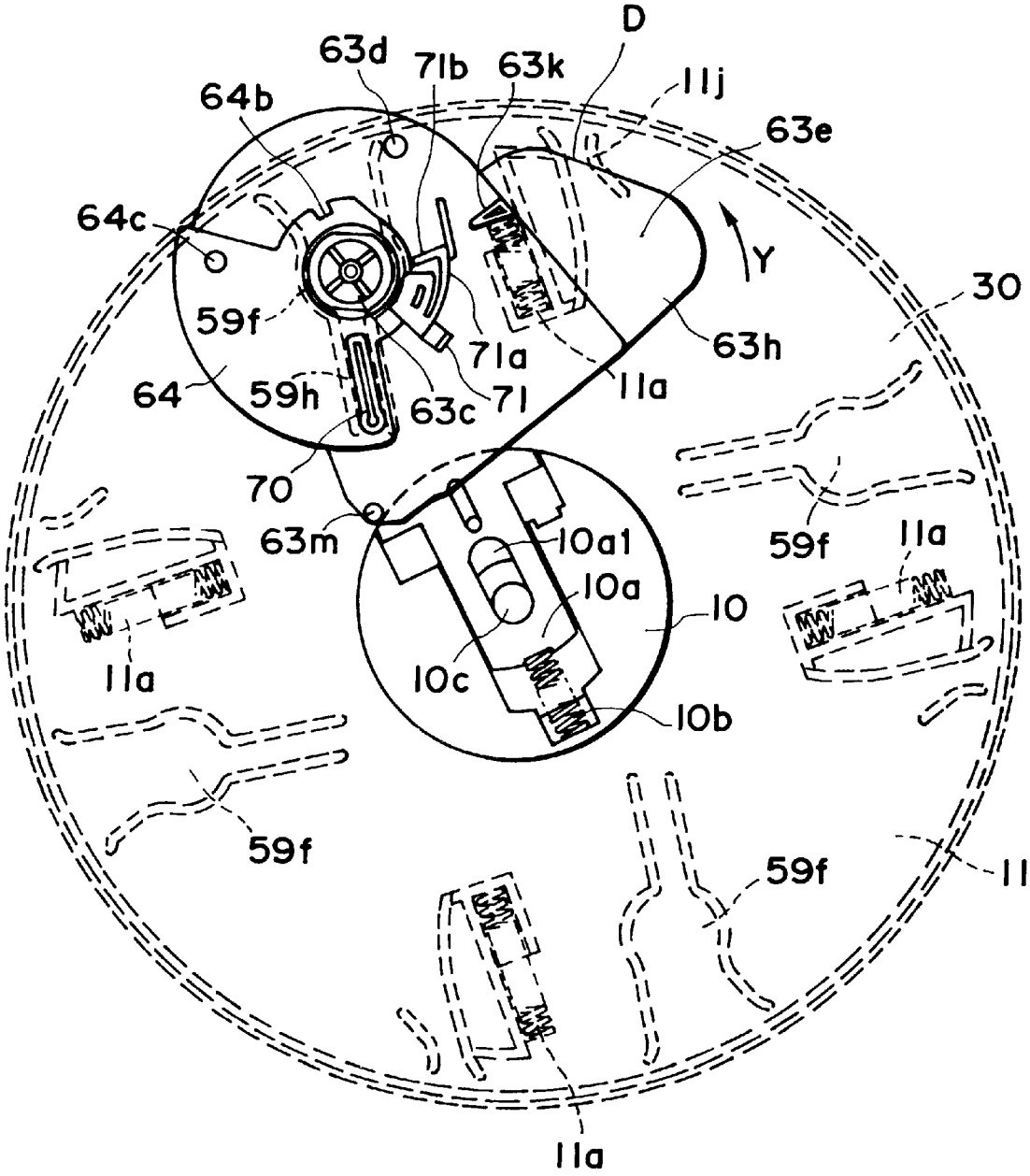
FIG. 24 is a side view showing a process of mounting a developing cartridge to a rotary unit.

When the developing cartridge D is rotated in the direction indicated by the arrow X in the state shown in FIG. 22, the orientation determination bosses 63*m* provided on the ends 63*h*, of the developing device frame 63 lowers translatable slide members 10*a* provided on the opposite ends of the center shaft 10 of the rotary unit and urged by springs 10*b*. The slide portion 10*a* is slidable by engagement between the elongated hole 10*a*1 and the shaft 10*c*. When the frame 63 is further rotated, as shown in FIG. 24, the spring receptor portion 63*k* provided on the opposite lateral ends of the frame 63, are pressed by the spring 11*a* provided at the end portions of the rotary unit. By this, the frame 63 is urged in the direction of rotation in the direction of arrow Y (FIG. 24). However, since the orientation determination bosses 63*m* abut the center shaft 10 of the rotary unit 11, the orientation of the frame 63 is stabilized at the mounting position shown in FIG. 24.

Thus, the developing cartridge D is mounted at a predetermined position of the rotary unit 11.

Designated by 11*j* is a guide portion for guiding the boss 63*m*.

By this, the shutter 64 is opened relative to the frame 63 to permit the developing roller 12 to be exposed and face the photosensitive drum 1. During this mounting operation, the user can feel the rotation start position for the developing cartridge D on the basis of the click feeling provided by the removal of the semi-spherical projection 63*d* from the hole 64*c* of the shutter 64.

The diameter of the arcuate portion of the projected portion 63*c* is larger than the distance between the cutting portions 63*c*1, and therefore, the projected portion 63*c* is not disengaged from the linear rib 59*c* when the projected portion 63*c* is rotated at the position of the arcuate rib 59*c*.

On the other hand, when the developing cartridge D is taken out of the main assembly 30 of the image forming apparatus, the user rotates the frame 63 in the opposite direction, by which the cutting portion 63*c*1 is brought to be parallel with the linear rib 59*c*, and the shutter 64 is closed. The user can feel the rotation completion position of the developing cartridge D on the basis of the click feeling upon the engagement of the semi-spherical projection 63*d* into the hole 64*c*. When the developing cartridge D is taken out of the main assembly of the apparatus, the arm portion 71*a* of the locking member 71 is elastically restored, and the engaging portion 71*b* enters the engagement recess 64*b*, as shown in FIG. 21. By this, the shutter 64 is automatically locked.

Since the developing cartridge D is provided with a shutter 64, the developing roller 12 is protected from deposition of foreign matter such as dust, and since the shutter 64 is provided with the locking mechanism, the shutter 64 is prevented from being unintentionally opened.

When the developing device is inserted into the main assembly 30 of the image forming apparatus, the shutter 64 maintains its closed state, and therefore, the developing roller 12 is not damaged during insertion. Additionally, it is not necessary for the user to remove a developing roller protection member or the like before insertion of the developing device.

Furthermore, the shutter locking is automatically released when the developing cartridge is mounted to the main assembly 30 of the image forming apparatus, and only by rotation thereof after the insertion, the shutter 64 is released, and the developing roller 12 faces the photosensitive drum 1, thus completing the mounting operation. Thus, the mounting operativity is improved.

A description will be provided as to positioning of the developing cartridge D.

Figure 25:
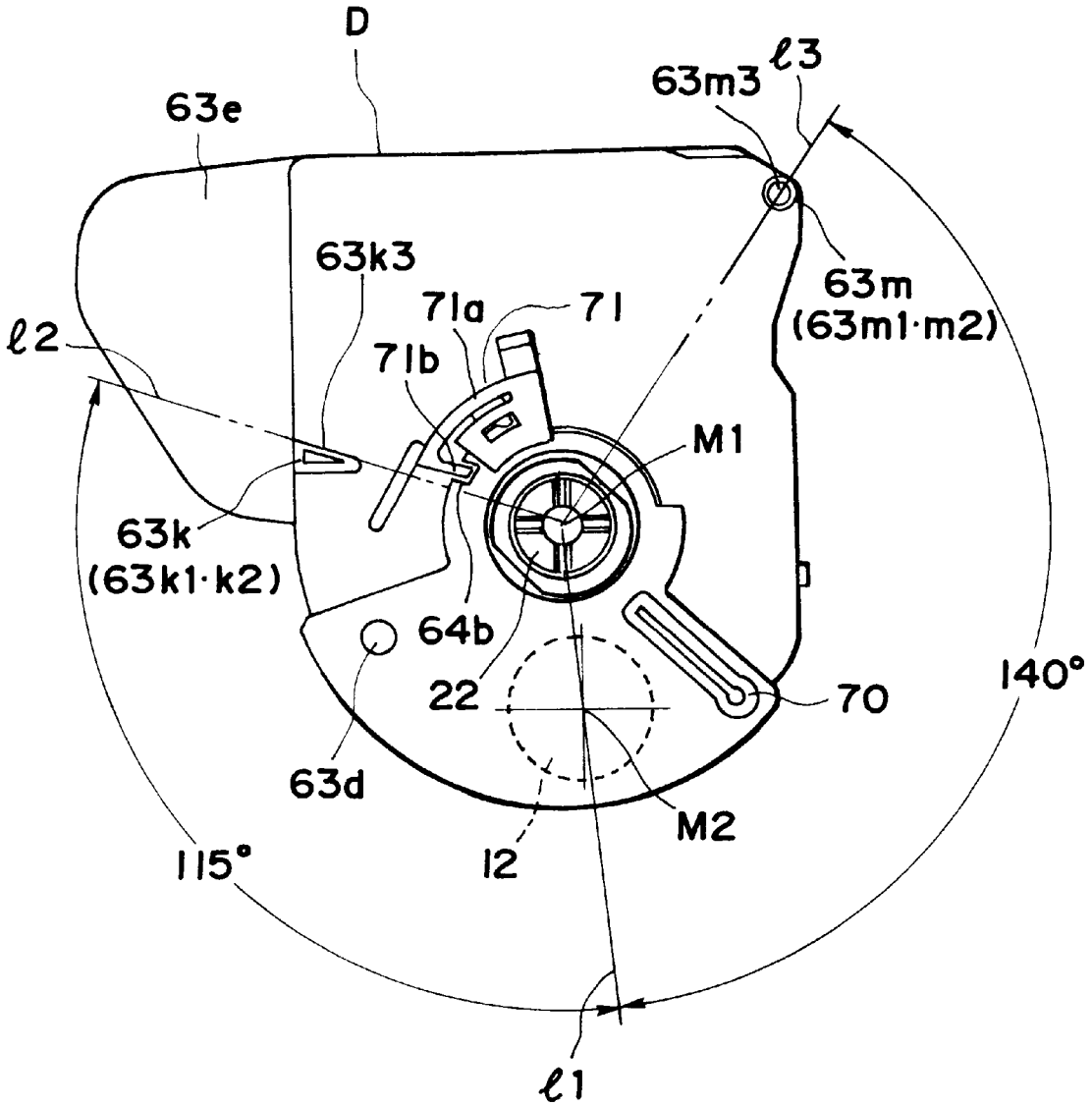
FIG. 25 is a side view showing a positional relation between a spring receptor and a boss.

Referring to FIG. 25, the arrangements of the spring receptor portion 63*k* (63*k*1, 63*k*2) and the orientation determination boss 63*m*, will be described.

One longitudinal end portion 63*h* of the developing roller 12 will be described, and the same applies to the other end portion 63*i*.

In this example, the spring receptor portion 63*k* is disposed within a range of approximately 100–130 degrees from a line 11 connecting a center of rotation M1 of the developing roller 12 and the center of rotation M2 of the driving force receptor portion 22 as seen in the longitudinal direction of the developing roller 12.

More particularly, in this example, the spring receptor portion 63*k*1 (63*k*2) is disposed at such a position that the angle formed between the line 11 connecting the center of rotation M1 of the developing roller 12 and the center of rotation M2 of the driving force receptor member 22, and the line 12 connecting the spring receptor surface 63*k*3 and the center of rotation M1, is approximately 100–130 degrees. In this example, the angle is approximately 115 degrees.

The boss 63*m* (63*m*1, 63*m*2) is disposed within a range of approximately 130–150 degrees from the line 11 across the line 11 from the spring receptor portion 63*k*.

More particularly, in this example, the angle formed between the line 11 and a line 13 connecting the center of the boss 63*m* and the center of rotation M1, is approximately 130–150 degrees. In this example, the angle is approximately 140 degrees.

By disposing the spring receptor portion 63*k* (63*k*1, 63*k*2) and the boss 63*m* (63*m*1, 63*m*2), the spring receptor portion 63*k* can properly receive the elastic force of the spring 11*a* provided in the main assembly of the apparatus 30. In addition, the boss 63*m* properly abuts the shaft 10. Therefore, the developing cartridge D is accurately positioned to the mounting position.

The boss 63*m* (63*m*1, 63*m*2) is projected outwardly from the side surface 63*h*, i of the frame 62 by approximately 2 mm–15 mm. In this example, the boss 63*m* is projected by approximately 4 mm.

The spring receptor portion 63*k* (63*k*1, 63*k*2) is projected outwardly from the side surface 63*h*, i by approximately 2 mm–20 mm. In this example, the spring receptor portion 63*k*1 is projected by approximately 10 mm, and 63*k*2 is projected by approximately 6 mm. Therefore, a projection length is larger in the spring receptor portion 63*k*1 provided at a driving force receiving side.

The features of the shutter of the developing cartridge D are summarized as follows.

The developing cartridge for developing a latent image formed on the photosensitive member, wherein the developing cartridge is detachably mountable to a main assembly of an electrophotographic image forming apparatus, and wherein the main assembly includes a main assembly guide for guiding the developing cartridge toward a mounting position in the main assembly, and includes a fixed portion, the developing cartridge comprises: a cartridge frame of plastic resin material; a developing roller 12 for developing, with toner, the latent image formed on the photosensitive member 1 of the main assembly of the apparatus, when mounted to the main assembly of the electrophotographic image forming apparatus, wherein the developing roller carries on its peripheral surface an amount of toner regulated by a development blade 16; a driving force receptor member 22 for receiving, from the main assembly of the device, a driving force for rotating the developing roller when the cartridge is mounted to the main assembly, the driving force receptor means being provided exposed adjacent one end of the cartridge frame portion 63*h* in a longitudinal direction of the developing roller; a toner accommodating portion 63*a* for accommodating the toner; a shutter 64 of plastic resin material which is movable between a closing position for covering a portion of the developing roller exposed from the cartridge frame portion 63 and an opening position for exposing the developing roller; a cartridge guide 70 for guiding the developing cartridge toward the mounting position by cooperation with the main assembly guide 26, 59 when the developing cartridge is to be mounted to the mounting position, the cartridge guide being provided on the shutter portion 64*e* which is movable along the cartridge frame portion 63*h* provided adjacent the one end, wherein the cartridge guide has an elongated shape and is extended toward the driving force receptor member 22; a locking member 71, of plastic resin material, for releasably locking the shutter at the closing position, the locking member 71 including locking engaging portion 71*b* engageable with a shutter engaging portion 64*b* provided in the shutter portion, a supporting portion 71*a* for supporting the locking engaging portion 71*b*, and a mounting portion 71*c* mounted on the cartridge frame portion, wherein the locking member is an integrally molded product of plastic resin material, and the shutter is locked at the closing position by engagement between the locking engaging portion and the shutter engaging portion, wherein in the process of mounting of the developing cartridge to a mounting position of the main assembly of the apparatus, a part of the locking member is contacted to a fixed portion 59*a* of the main assembly of the apparatus, so that supporting portion 71*a* is flexed to disengage the locking engaging portion from the shutter engaging portion, thus releasing locking of the shutter; wherein in the process of mounting of the developing cartridge to a mounting position of the main assembly of the apparatus, a part of the locking member is contacted to a fixed portion 59*a* of the main assembly of the apparatus, so that supporting portion 71*a* is flexed to disengage the locking engaging portion 71*b* from the shutter engaging portion 64*b*, thus releasing locking of the shutter 64, and wherein the shutter is positioned at the opening position by a user rotating the cartridge frame to mount the developing cartridge at the mounting position while the guide is in engagement with a main assembly guide of the main assembly of the apparatus.

The supporting portion 64*e* is rotatable about the same axis as that of the driving force receptor member 22.

The cartridge guide 70 has an elongated shape, and is extended toward the driving force receptor means 22.

The cartridge D further comprises an urged portion 63*g* on the cartridge frame portion adjacent the one end, wherein the urged portion is urged by the elastic force of a spring member provided in the main assembly of the apparatus, wherein the developing cartridge is urged toward the one end by the elastic force of the spring member.

The features of the structure for the mounting of the developing cartridge D to the main assembly of the apparatus 30 are summarized as follows.

The developing cartridge D, for developing a latent image formed on the photosensitive member 1, is detachably mountable to a main assembly 30 of an electrophotographic image forming apparatus. The developing cartridge comprises: a cartridge frame 63; developing means (roller 12) for developing, with toner, the latent image formed on the photosensitive member of the main assembly of the apparatus, when mounted to the main assembly of the electrophotographic image forming apparatus; a first projected portion 63*c* projected from a frame portion 63*h* of the cartridge adjacent one longitudinal end of the developing means, wherein the first projected portion is supported by a first supporting member 59 provided in the main assembly, when the cartridge is mounted to the main assembly of the electrophotographic image forming apparatus; a second projected portion 63*g* projected from the frame portion 63*i* adjacent the other longitudinal end of the developing means, wherein the second projected portion is supported by a second supporting member 26 provided in the main assembly, when the cartridge is mounted to the main assembly of the electrophotographic image forming apparatus; a driving force receptor member 22 for receiving, from the main assembly of the device, a driving force for rotating the developing means, when the cartridge is mounted to the main assembly, wherein the driving force receptor member is exposed from the frame portion 63*h* adjacent the one end; and a guide 70 for guiding the developing cartridge toward a mounting position when the cartridge is mounted to the main assembly.

The guide 70 is movable along an outside of the frame portion 63*g* adjacent the one end.

The guide 70 has an elongated shape, and is rotatable about the driving force receptor member 22. A longitudinal direction of the guide 70 is directed to the driving force receptor member 22. The cartridge further comprises a rotatable member (shutter 64) rotatably mounted on the frame portion 63.

The guide is provided on the rotatable member, and more specifically, the guide 70 is provided on the rotatable member 64.

The rotatable member 64 includes a shutter 64 for covering a portion of the developing means exposed from the cartridge frame 63.

The shutter 64 is movable between a closing position for covering the exposed portion and an opening position for exposing the developing means.

The guide 70 is projected longitudinally outwardly and is provided on the shutter 64.

The guide 74 is provided on a portion of the shutter 64 which is movable along an outside of the cartridge frame portion 63*h* adjacent the one end.

The first projected portion 63*c* includes two flat surface portions 63*c*1, opposed to each other, for guiding the developing cartridge toward the mounting position in the main assembly when the cartridge is mounted to the main assembly, and two curved surface portions 63*c*2, opposed to each other, for engaging with a recess 59*f* of the first supporting member 59.

The second projected portion 63*g* includes two flat surface portions 63*g*3, opposed to each other, for guiding the developing cartridge toward the mounting position in the main assembly when the cartridge is mounted to the main assembly, and two curved surface portions 63*g*4, opposed to each other, for engaging with a recess 26*a* of the second supporting member 26. A distance L1 (FIG. 17, (a)) between outside surfaces of the flat surface portion 63*c*1 of the first projected portion 63*c*, is larger than a distance L2 (FIG. 17, (a)) between outside surfaces of the flat surface portion 63g3 of the second projected portion 63g.

A distance L1 between outer surfaces of the flat surface portions 63c1 of the first projected portion is approximately 13 mm–15 mm, and a distance L2 between outer surfaces of the flat surface portions 63g3 of the second projected portion 63g is approximately 2 mm–9 mm. In this embodiment, L1 is approximately 15 mm, and L2 is approximately 9 mm.

A distance L3 (FIG. 17, (b)) between remotest outer surface portions of the curved surface portions 63c2 of the first projected portion 63c is approximately 13 mm–17 mm, and a distance L4 (FIG. 17, (a)) between remotest outer surface portions of the curved surface portions 63g4 of the second projected portion 63g is approximately 7 mm–11 mm. In this embodiment, L3 is approximately 17 mm, and L4 is approximately 11 mm.

The driving force receptor member 22 is enclosed by the first projected portion 63c. The driving force receptor member 22 is provided with a recess 22a for engagement with a projection 24a of the main assembly of the apparatus, wherein by engagement between the projection and the recess, a driving force is transmitted from the main assembly to the developing means.

The curved surface portion is of a continuous arcuate configuration.

When the developing cartridge D rotates from the mounting position (FIG. 24) to a development position (FIGS. 13 and 14) for developing a latent image formed on the photosensitive member, the developing cartridge rotates about the first projected portion 63c and second projected portion 63g.

The developing cartridge reaches the mounting position (FIG. 24) by approximately 90–120 degrees rotation from a mounting-and-demounting position (FIG. 22) about the first projected portion 63c and the second projected portion 63g. The mounting-and-demounting position (FIG. 22) is a position where the first projected portion 63c and the second projected portion 63g enters the first supporting member 59 and the second supporting member 26, and where the flat surface portion 63g3 is opposing to engaging portions of the first supporting member and the second supporting member, respectively. In this embodiment, it is rotated through approximately 105 degrees.

The developing cartridge reaches a developing position by approximately 5–10 degrees rotation from the mounting position about the first projected portion 63c and the second projected portion 63g. The developing position is a position where spacer rollers 12a of the developing member is urged to the electrophotographic photosensitive member 1. In this embodiment, it is rotated through approximately 7 degrees.

The guide 70 functions to guide the developing cartridge D into the main assembly, and is displaceable relative to the first projection.

The guide 70 has an elongated shape, and rotates through approximately 90–120 degrees relative to the first projected portion 63c to mount the developing cartridge at the mounting position in main assembly of the apparatus.

The cartridge further comprises a driving force receptor member 22 for receiving, from the main assembly of the device, a driving force for rotating the developing roller 12 when the developing cartridge is mounted to the main assembly of the device, wherein the driving force receptor member 22 is provided on the same longitudinal end as the first projected portion 63c, and wherein the guide is provided only of the same side. Thus, the guide 70 is provided only on one side 63h, and therefore, the developing cartridge D can be smoothly mounted.

The mounting position of the developing cartridge is a position where the developing cartridge is correctly positioned in place in the main assembly of the apparatus.

The development position of the developing cartridge is a position where the developing cartridge is positioned for effecting the development operation.

The mounting-and-demounting position of the developing cartridge is a position where the developing cartridge is mounted to or demounted from the supporting member provided in the main assembly of the apparatus. The supporting member is a member for supporting the developing cartridge when the developing cartridge is to be mounted to the mounting position.

The features for the positioning of the developing cartridge D relative to the main assembly of the apparatus are summarized as follows.

The developing cartridge D, for developing a latent image formed on the photosensitive member 1, is detachably mountable to a main assembly 30 of an electrophotographic image forming apparatus. The developing cartridge comprises: a cartridge frame 63; developing roller 12 for developing, with toner, the latent image formed on the photosensitive member 1 of the main assembly of the apparatus, when mounted to the main assembly of the electrophotographic image forming apparatus; a first projected portion 63c outwardly projected from the cartridge frame portion 63h adjacent one longitudinal end of the developing means, wherein the first projected portion is supported by a first supporting member 59 provided in the main assembly 30 of the apparatus when the cartridge is mounted to the main assembly; a second projected portion 63g outwardly projected from the cartridge frame portion adjacent the other longitudinal end of the developing means, wherein the second projected portion is supported by a second supporting member 26 provided in the main assembly of the apparatus when the cartridge is mounted to the main assembly 30; a first urging force receptor portion 63k1 outwardly projected from the cartridge frame portion 63h adjacent one longitudinal end of the developing means, wherein the first urging force receptor portion receives an urging force by a first elastic member 11a provided in the main assembly 30 when the cartridge is mounted to the main assembly, and wherein the first urging force receptor portion is integrally molded with the cartridge frame; a second urging force receptor portion 63k2 outwardly projected from the cartridge frame portion 63i adjacent the other longitudinal end of the developing means, wherein the second urging force receptor portion receives an urging force by a second elastic member 11a provided in the main assembly when the cartridge is mounted to the main assembly, and wherein the second urging force receptor portion is integrally molded with the cartridge frame; a first contact portion 63m1 outwardly projected from the cartridge frame portion 63h adjacent one longitudinal end of the developing means, wherein the first contact portion contacts a first fixed portion 10 provided in the main assembly when the cartridge is mounted to the main assembly, wherein the first contact portion is integrally molded with the cartridge frame; a second contact portion 63m2 outwardly projected from the cartridge frame portion 63i adjacent one longitudinal end of the developing means, wherein the second contact portion contacts a second fixed portion 10 provided in the main assembly when the cartridge is mounted to the main assembly, and wherein the second contact portion is integrally molded with the cartridge frame; a driving force receptor member 22 for receiving, from the main assembly 30, a driving force for rotating the developing means when the cartridge is mounted to the main assembly, wherein the driving force receptor member is exposed from the cartridge frame portion adjacent one longitudinal end of the developing roller; wherein as seen in a direction substantially perpendicular to the longitudinal direction of the developing means, the first urging force receptor portion and the second urging force receptor portion are within a range of approximately 100–130 degrees from a line connecting a center of rotation of the developing means and a center of rotation of the driving force reception member, and wherein the first contact portion and second contact portion are within a range of approximately 130–150 degrees.

The first receptor portion 63*k* and the second one 63*k* are flat in shape, and receive the urging forces from the first urging member 11*a* and the second one 11*a*.

The first contact portion 63*m*1 and second contact portion 63*m*2 are in the form of circular columns, and its peripheral surface portions are contacted to the first fixed portion 10 and second fixed portion 10.

The structures of the cartridge frame, the developing roller, the driving force receptor member, the toner accommodating portion, the shutter, cartridge guide, the locking member, the fixing portion, the first projected portion, the second projected portion, the first and second urging force receptors, the portion, the second urging force receptor, the portion, the first contact portion, the second contact portion, the first fixed portion, and second fixed portion, are not limited to those described above, but may be modified.

A further embodiment will be described.

Figure 26:
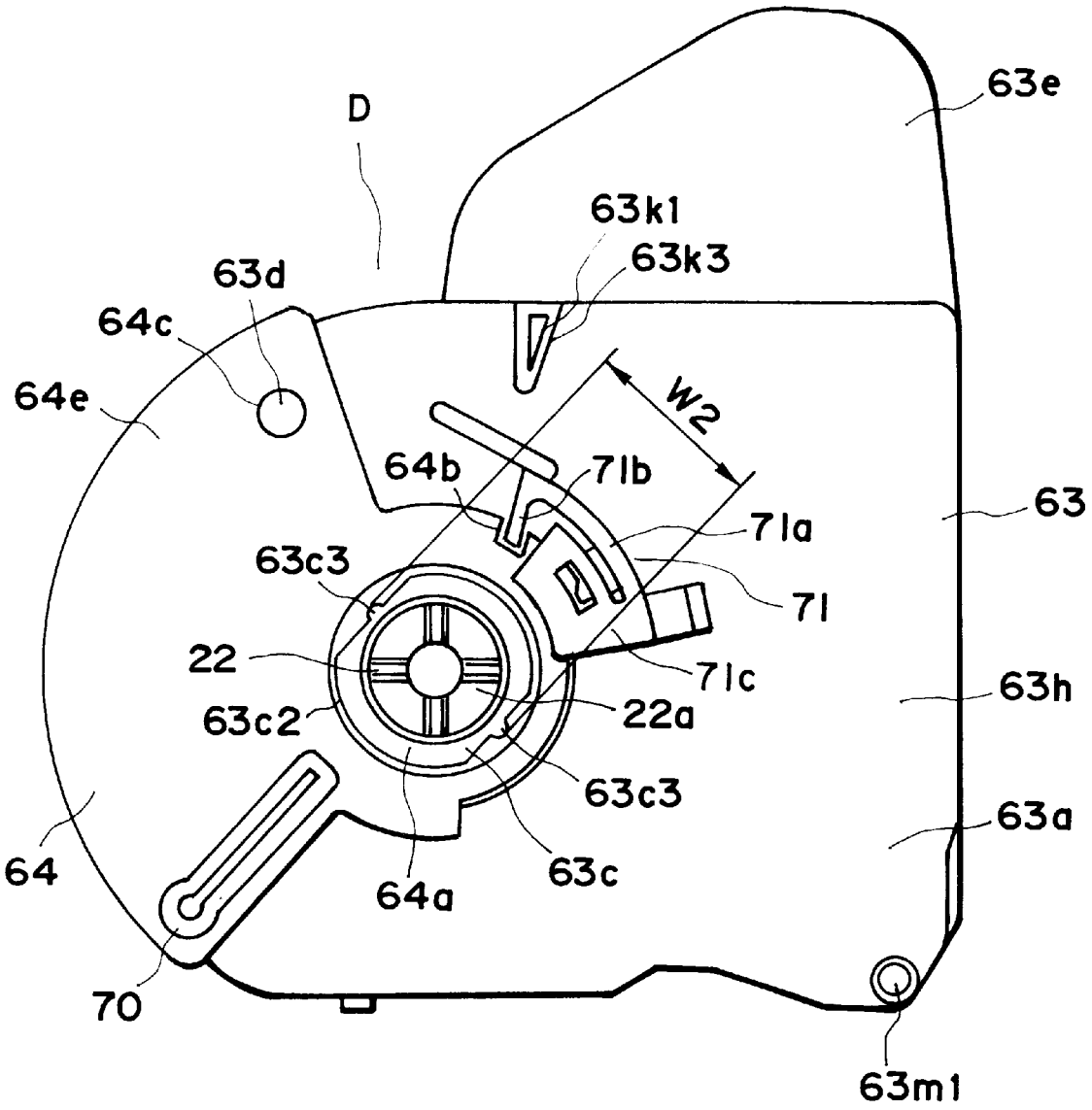
FIG. 26 is a side view of a developing cartridge according to another embodiment.

FIG. 26 is a side view of one end of the developing cartridge D.

In this example, another shape of the projected portion 63*c* is used.

It is not inevitable to cut a cylindrical portion provided on an end surface of the frame 63 of the developing cartridge D to provide the projected portion 63*c*. As shown in FIG. 25, the linear portion 63*c*1 may be provided with at least one projection 63*c*3 so that width is smaller than the rib clearance W1 (FIG. 19) of the inlet of the guide 59. The insertion is possible with the structure.

By this, the contact resistance with the rib of the guide 59 can be reduced to make the insertion of the developing cartridge D smoother.

Figure 27:
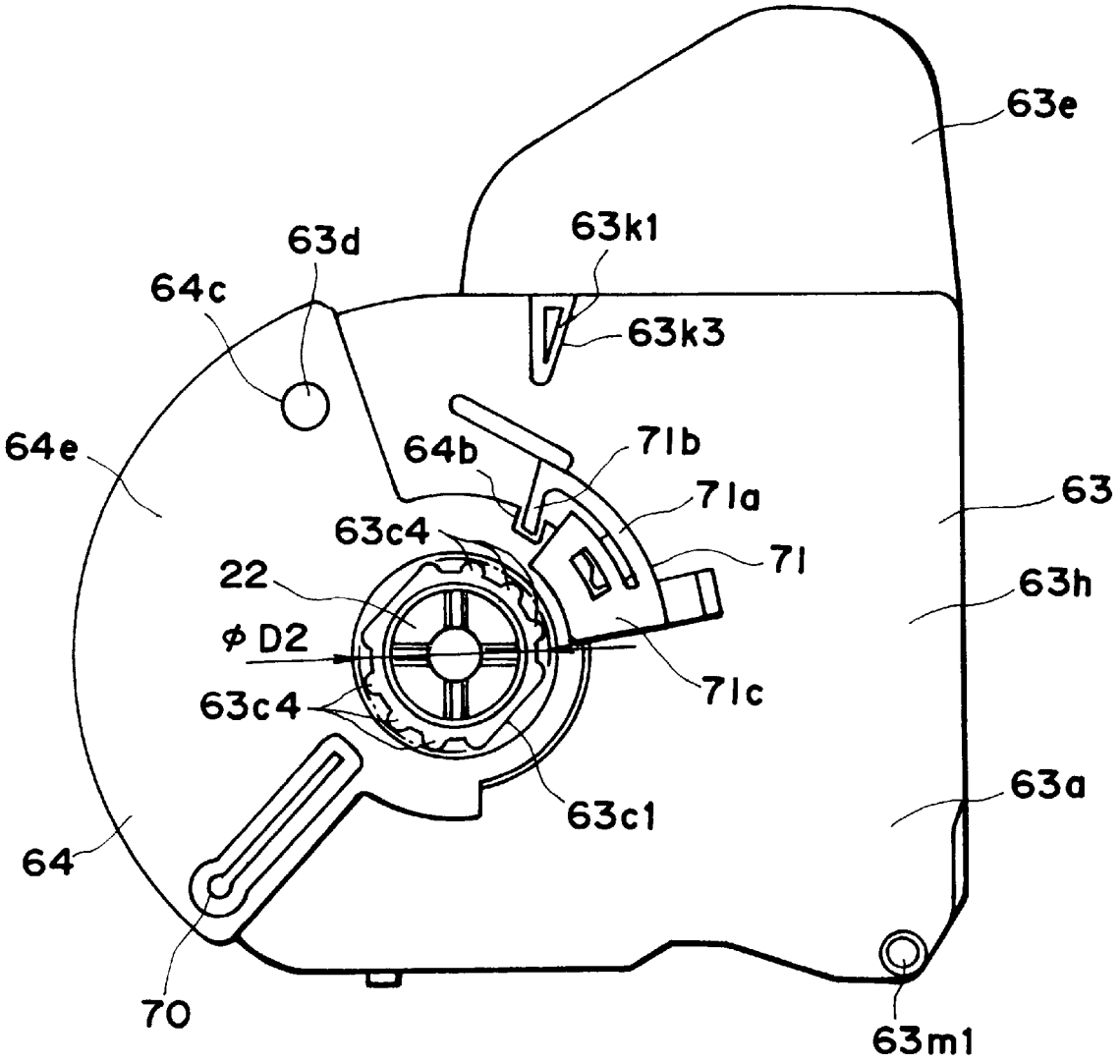
FIG. 27 is a side view of a developing cartridge according to another embodiment.

Referring to FIG. 27, a further embodiment will be described.

In FIG. 27, cylindrical projection 63*c* provided on a side 63*h* of the frame 63 of the developing cartridge, has a configuration having a plurality of projections 63*c*4 contactable to the arcuation of such a diameter D2 as is engageable with the diameter D1 (FIG. 19) of the arcuate rib of the guide 59.

By this, the contact resistance with the rib of the guide 59 can be decreased to make smooth the rotation upon mounting of the developing cartridge D to the main assembly of the apparatus 30.

Figure 28:
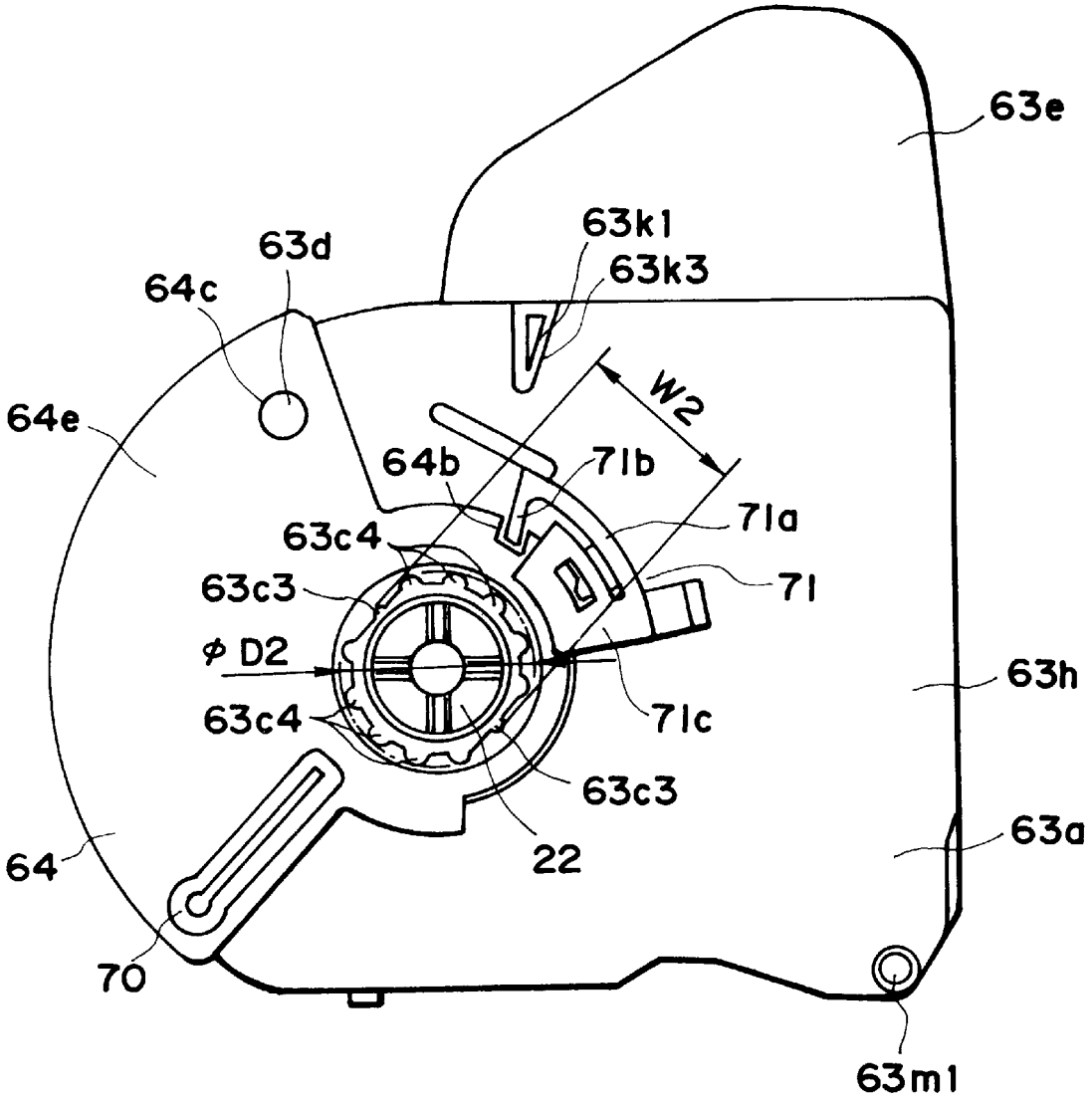
FIG. 28 is a side view of a developing cartridge according to another embodiment.

FIG. 28 shows a further example wherein the structures of FIGS. 26 and 27 are used in combination, as will be understood from this figure.

Figure 29:
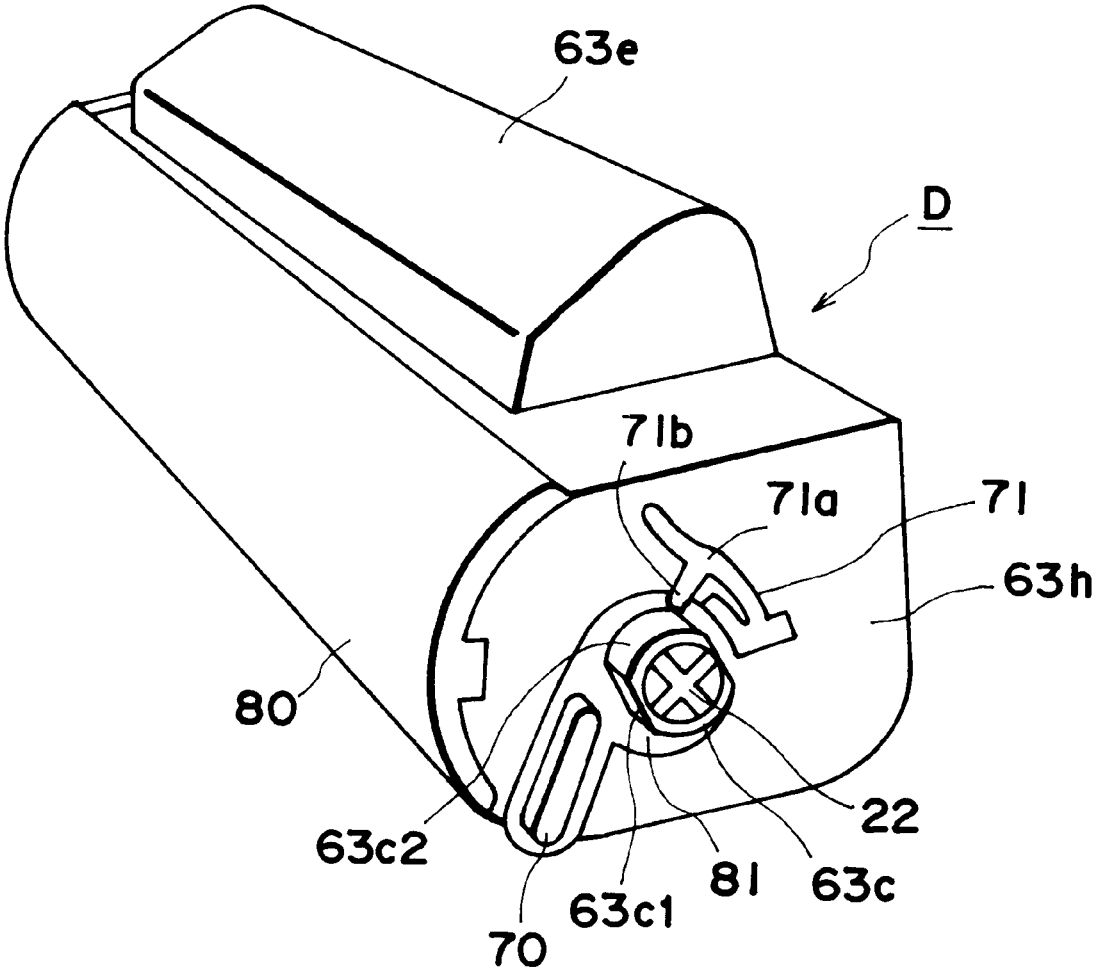
FIG. 29 shows another embodiment.

Referring to FIG. 29, another embodiment will be described.

In this embodiment, the shutter 80 is removed from the cartridge frame 63 by a user, or is mounted by the user. The guide 70 is provided in a rotatable member not in the shutter 80. The rotatable member 81 is rotatable about a projection 63*c* along a side 63*h* of the cartridge frame. It is locked by the above-described locking member 71. Therefore, the guide 70 has the same function as described in the foregoing and the developing cartridge D can be mounted to the main assembly 30 in the same manner.

Prior to mounting the developing cartridge D to the main assembly 30, the shutter 80 is removed from the frame 63 by the user. When the cartridge D is demounted from the main assembly 30, the shutter is remounted to the frame by the user, as desired. The shutter is not inevitable, and may not be provided.

The guide 70 may not be provided on the rotatable member 81, but may be mounted directly on the cartridge frame. In this case, the guide is rotatably mounted on the cartridge frame 63.

According to the foregoing embodiments, the projections on longitudinal end surfaces of the developing cartridge frame are guided when the developing cartridge is mounted to the main assembly of the image forming apparatus, so that the developing cartridge can be inserted in a direction perpendicular to the longitudinal direction, and therefore, the insertion stroke can be reduced to improve the insertion operativity.

The driving connection between the developing cartridge and the main assembly is effected with the coupling configuration, so that a decrease of the driving accuracy due to the driving gear pitch nonuniformity, for example, can be prevented.

The foregoing cartridge frame, shutter or the like are made of plastic resin material such as polystyrene, ABS resin, polycarbonate, polyethylene, polypropylene, or the like.

The process cartridge is not limited to those described in the foregoing, but may contain as an unit at least one process means such as charging means, cleaning means or the like, and an electrophotographic photosensitive member, wherein the cartridge is detachably mountable relative to the main assembly of an electrophotographic image forming apparatus.

According to the present invention, the mounting operativity of the developing cartridge is improved.

Additionally, the developing cartridge can be mounted in the main assembly of the electrophotographic image forming apparatus with high positional accuracy.

Furthermore, since the urging force receptor portion and the contact portion are projected outwardly from the cartridge frame, the configuration of the cartridge frame can be selected with greater latitude.

While the invention has been described with reference to the structures disclosed herein, it is not confined to the details set forth and this application is intended to cover such modifications or changes as may come within the purposes of the improvements or the scope of the following claims.

What is claimed is:

1. A developing cartridge for developing a latent image formed on a photosensitive member, wherein said developing cartridge is detachably mountable to a main assembly of an electrophotographic image forming apparatus, said developing cartridge comprising:

a cartridge frame;

developing means for developing, with the toner, the latent image formed on the photosensitive member of the main assembly of the apparatus, when said cartridge is mounted to the main assembly of the electrophotographic image forming apparatus;

a first projected portion outwardly projected from said cartridge frame portion adjacent one longitudinal end of said developing means, wherein said first projected portion is supported by a first supporting member provided in the main assembly of the apparatus when said cartridge is mounted to the main assembly;

a second projected portion outwardly projected from said cartridge frame portion adjacent the other longitudinal end of said developing means, wherein said second projected portion is supported by a second supporting member provided in the main assembly of the apparatus when said cartridge is mounted to the main assembly;

a first urging force receptor portion outwardly projected from said cartridge frame portion adjacent said one longitudinal end of said developing means, wherein said first urging force receptor portion receives an urging force by a first elastic member provided in the main assembly when said cartridge is mounted to the main assembly;

a second urging force receptor portion outwardly projected from said cartridge frame portion adjacent the other longitudinal end of said developing means, wherein said second urging force receptor portion receives an urging force by a second elastic member provided in the main assembly when said cartridge is mounted to the main assembly;

a first contact portion outwardly projected from said cartridge frame portion adjacent said one longitudinal end of said developing means, wherein said first contact portion contacts a first fixed portion provided in the main assembly when said cartridge is mounted to the main assembly;

a second contact portion outwardly projected from said cartridge frame portion adjacent the other longitudinal end of said developing means, wherein said second contact portion contacts a second fixed portion provided in the main assembly when said cartridge is mounted to the main assembly.

2. A cartridge according to claim 1, wherein as seen in the longitudinal direction of a developing roller of said developing means, said first urging force receptor portion is disposed such that an angle formed between a first line connecting a center of rotation of said developing roller and a center of rotation of a driving force reception member and a second line connecting a portion of said first urging force receptor portion and the center of rotation of said driving force reception member, is 100–130 degrees, and said driving force reception member receives a driving force for rotating said developing roller when said developing cartridge is mounted to the main assembly.

3. A cartridge according to claim 2, wherein as seen in the longitudinal direction of said developing roller, said first contact portion is disposed such that an angle formed between said first line and a third line connecting a center of said first contact portion and a center of rotation of said driving force reception member, is 130–150 degrees.

4. A cartridge according to claim 1, wherein said first urging force receptor portion and second urging force receptor portion are in the form of flat plates, and reception the urging force by said first elastic member and the urging force by said second elastic member.

5. A cartridge according to claim 4, wherein said first urging force receptor portion is integrally molded with a first frame member constituting said cartridge frame, and said second urging force receptor portion is integrally molded with a second frame member constituting said cartridge frame.

6. A cartridge according to claim 4 or 5, wherein said first urging force receptor portion and second urging force receptor portion are projected outwardly from said cartridge frame by 2 mm–20 mm.

7. A cartridge according to claim 1, wherein said first contact portion and second contact portion are in the form of circular columns, and its peripheral surface portions are contacted to said first fixed portion and second fixed portion.

8. A cartridge according to claim 7, wherein said first contact portion is integrally molded with said cartridge frame, and said second contact portion is integrally molded with said cartridge frame.

9. A cartridge according to claim 7 or 8, wherein said first contact portion and second contact portion are outwardly projected outwardly from said cartridge frame by 2 mm–15 mm.

10. A cartridge according to claim 1, wherein said first projected portion and said second projected portion have flat surface portions and curved surface portions, and said curved surface portions are rotatably engaged with said first supporting member and second supporting member, respectively.

11. A cartridge according to claim 1, wherein as seen in the longitudinal direction of a developing roller of said developing means, said second urging force receptor portion is disposed such that an angle formed between a first line connecting a center of rotation of said developing roller and a center of rotation of a driving force reception member and a second line connecting a portion of second urging force receptor portion and the center of rotation of said driving force reception member, is with a range of 100–130 degrees, and said driving force reception member receives a driving force for rotating said developing roller when said developing cartridge is mounted to the main assembly.

12. A cartridge according to claim 11, wherein as seen in the longitudinal direction of said developing roller, said second contact portion is disposed such that an angle formed between said first line and a third line connecting a center of the second contact portion and a center of rotation of said driving force reception member, is 130–150 degrees.

13. A developing cartridge for developing a latent image formed on a photosensitive member, wherein said developing cartridge is detachably mountable to a main assembly of an electrophotographic image forming apparatus, said developing cartridge comprising:

a cartridge frame;

a developing roller for developing, with toner, the latent image formed on the photosensitive member of the main assembly of the apparatus, when said cartridge is mounted to the main assembly of the electrophotographic image forming apparatus;

a first projected portion outwardly projected from said cartridge frame portion adjacent one longitudinal end of said developing roller, wherein said first projected portion is supported by a first supporting member provided in the main assembly of the apparatus when said cartridge is mounted to the main assembly;

a second projected portion outwardly projected from said cartridge frame portion adjacent the other longitudinal end of said developing roller, wherein said second projected portion is supported by a second supporting member provided in the main assembly of the apparatus when said cartridge is mounted to the main assembly;

a first urging force receptor portion outwardly projected from said cartridge frame portion adjacent said one longitudinal end of said developing roller, wherein said first urging force receptor portion receives an urging force by a first elastic member provided in the main assembly when said cartridge is mounted to the main assembly;

a second urging force receptor portion outwardly projected from said cartridge frame portion adjacent the other longitudinal end of said developing roller, wherein said second urging force receptor portion receives an urging force by a second elastic member provided in the main assembly when said cartridge is mounted to the main assembly;

a first contact portion outwardly projected from said cartridge frame portion adjacent said one longitudinal end of said developing roller, wherein said first contact portion contacts a first fixed portion provided in the main assembly when said cartridge is mounted to the main assembly;

a second contact portion outwardly projected from said cartridge frame portion adjacent the other longitudinal end of said developing roller, wherein said second contact portion contacts a second fixed portion provided in the main assembly when said cartridge is mounted to the main assembly; and a driving force receptor member for receiving, from the main assembly, a driving force for rotating said developing roller when said cartridge is mounted to the main assembly, wherein said driving force receptor member is exposed from said cartridge frame portion adjacent one longitudinal end of said developing roller, wherein as seen in the longitudinal direction of said developing roller, said first urging force receptor portion is disposed such that an angle formed between a first line connecting a center of rotation of said developing roller and a center of rotation of a driving force reception member and a second line connecting a portion of said first urging force receptor portion and the center of rotation of said driving force reception member, is 100–130 degrees, and said driving force reception member receives a driving force for rotating said developing roller when said developing cartridge is mounted to the main assembly, said second urging force receptor portion is disposed such that an angle formed between a first line connecting a center of rotation of said developing roller and a center of rotation of a driving force reception member and a line connecting a portion of said second urging force receptor portion and the center of rotation of said driving force reception member, is 100–130 degrees, and said driving force reception member receives a driving force for rotating said developing roller when said developing cartridge is mounted to the main assembly.

14. A cartridge according to claim 13, wherein said first urging force receptor portion and second urging force receptor portion are in the form of flat plates, and reception the urging force by said first elastic member and the urging force by said second elastic member.

15. A cartridge according to claim 14, wherein said first urging force receptor portion is integrally molded with a first frame member constituting said cartridge frame, and said second urging force receptor portion is integrally molded with a second frame member constituting said cartridge frame.

16. A cartridge according to claim 14 or 15, wherein said first urging force receptor portion and second urging force receptor portion are projected outwardly from said cartridge frame by 2 mm–20 mm.

17. A cartridge according to claim 13, wherein said first contact portion and second contact portion are in the form of circular columns, and their peripheral surface are contacted to said first fixed portion and second fixed portion.

18. A cartridge according to claim 17, wherein said first contact portion is integrally molded with a first frame member constituting said cartridge frame, and said second contact portion is integrally molded with a second frame member constituting said cartridge frame.

19. A cartridge according to claim 17 or 18, wherein said first contact portion and second contact portion are outwardly projected outwardly from said cartridge frame by 2 mm–15 mm.

20. A cartridge according to claim 13, wherein said first projected portion and said second projected portion have flat surface portions and curved surface portions, and said curved surface portions are rotatably engaged with said first supporting member and second supporting member, respectivevely.

21. A cartridge according to claim 13 wherein as seen in the longitudinal direction of said developing roller, said first contact portion is disposed such that an angle formed between said first line and a third line connecting a center of the first contact portion and a center of rotation of said driving force reception member, is 130–150 degrees.

22. A cartridge according to claim 21 wherein as seen in the longitudinal direction of said developing roller, said second contact portion is disposed such that an angle formed between said first line and a third line connecting a center of the second contact portion and a center of rotation of said driving force reception member, is 130–150 degrees.

23. A developing cartridge for developing a latent image formed on a photosensitive member, wherein said developing cartridge is detachably mountable to a main assembly of an electrophotographic image forming apparatus, said developing cartridge comprising:

a cartridge frame;

a developing roller for developing, with toner, the latent image formed on the photosensitive member of the main assembly of the apparatus, when said cartridge is mounted to the main assembly of the electrophotographic image forming apparatus;

a first projected portion outwardly projected from said cartridge frame portion adjacent one longitudinal end of said developing roller, wherein said first projected portion is supported by a first supporting member provided in the main assembly of the apparatus when said cartridge is mounted to the main assembly;

a second projected portion outwardly projected from said cartridge frame portion adjacent the other longitudinal end of said developing means, wherein said second projected portion is supported by a second supporting member provided in the main assembly of the apparatus when said cartridge is mounted to the main assembly;

a first urging force receptor portion outwardly projected from said cartridge frame portion adjacent one longitudinal end of said developing roller, wherein said first urging force receptor portion receives an urging force by a first elastic member provided in the main assembly when said cartridge is mounted to the main assembly, and wherein said first urging force receptor portion is integrally molded with a first frame member constituting said cartridge frame;

a second urging force receptor portion outwardly projected from said cartridge frame portion adjacent the other longitudinal end of said developing roller, wherein said second urging force receptor portion receives an urging force by a second elastic member provided in the main assembly when said cartridge is mounted to the main assembly, and wherein said second urging force receptor portion is integrally molded with a second frame member constituting said cartridge frame;

a first contact portion outwardly projected from said cartridge frame portion adjacent said one longitudinal end of said developing roller, wherein said first contact portion contacts a first fixed portion provided in the main assembly when said cartridge is mounted to the main assembly, wherein said first contact portion is integrally molded with the first frame member constituting said cartridge frame;

a second contact portion outwardly projected from said cartridge frame portion adjacent the other longitudinal end of said developing roller, wherein said second contact portion contacts a second fixed portion provided in the main assembly when said cartridge is mounted to the main assembly, and when said second contact portion is integrally molded with the second frame member constituting said cartridge frame;

a driving force receptor member for receiving, from the main assembly, a driving force for rotating said developing roller when said cartridge is mounted to the main assembly, wherein said driving force receptor member is exposed from said cartridge frame portion adjacent one longitudinal end of said developing roller, wherein as seen in a longitudinal direction of said developing roller, each of said first and second urging force receptor portions is disposed such that an angle formed between a first line connecting a center of rotation of said developing roller and a center of rotation of a driving force reception member and a second line connecting a portion of said first or second urging force receptor portion and the center of rotation of said driving force reception member, is 100–130 degrees, and said driving force reception member receives a driving force for rotating said developing roller when said developing cartridge is mounted to the main assembly, and wherein as seen in the longitudinal direction of said developing roller each of said first and second contact portions is disposed such that an angle formed between said first line and a third line connecting a center of said first or second contact portion and a center of rotation of said driving force reception member, is 130–150 degrees.

24. A cartridge according to claim 23, wherein said first urging force receptor portion and second urging force receptor portion are in the form of flat plates, and reception the urging force by said first elastic member and the urging force by said second elastic member.

25. A cartridge according to claim 23 or 24 wherein said first urging force receptor portion and second urging force receptor portion are projected outwardly from said cartridge frame by 2 mm–20 mm.

26. A cartridge according to claim 23 wherein said first contact portion and second contact portion are in the form of circular columns, and its peripheral surface portions are contacted to said first fixed portion and second fixed portion.

27. A cartridge according to claims 23 or 26, wherein said first contact portion and second contact portion are outwardly projected outwardly from said cartridge frame by 2 mm–15 mm.

28. A cartridge according to claim 23, wherein said first projected portion and said second projected portion have flat surface portions and curved surface portions, and said curved surface portions are rotatably engaged with said first supporting member and second supporting member, respectively.

29. An electrophotographic image forming apparatus for forming an image on a recording material, comprising:

a. an electrophotographic photosensitive member;

b. a first supporting member;

c. a second supporting member;

d. a first elastic member;

e. a second elastic member;

f. a first fixed portion;

g. a second fixed portion;

h. a mounting member for detachably mounting a developing cartridge; said developing cartridge comprising:

developing means for developing, with toner, the latent image formed on the photosensitive member of the main assembly of the apparatus, when said cartridge is mounted to the main assembly of the electrophotographic image forming apparatus;

a first projected portion outwardly projected from said cartridge frame portion adjacent one longitudinal end of said developing means, wherein said first projected portion is supported by a first supporting member provided in the main assembly of the apparatus when said cartridge is mounted to the main assembly;

a second projected portion outwardly projected from said cartridge frame portion adjacent the other longitudinal end of said developing means, wherein said second projected portion is supported by a second supporting member provided in the main assembly of the apparatus when said cartridge is mounted to the main assembly;

a first urging force receptor portion outwardly projected from said cartridge frame portion adjacent said one longitudinal end of said developing means, wherein said first urging force receptor portion receives an urging force by a first elastic member provided in the main assembly when said cartridge is mounted to the main assembly;

a second urging force receptor portion outwardly projected from said cartridge frame portion adjacent the other longitudinal end of said developing means, wherein said second urging force receptor portion receives an urging force by a second elastic member provided in the main assembly when said cartridge is mounted to the main assembly;

a first contact portion outwardly projected from said cartridge frame portion adjacent said one longitudinal end of said developing means, wherein said first contact portion contacts a first fixed portion provided in the main assembly when said cartridge is mounted to the main assembly;

a second contact portion outwardly projected from said cartridge frame portion adjacent the other longitudinal end of said developing means, wherein said second contact portion contacts a second fixed portion provided in the main assembly when said cartridge is mounted to the main assembly; and i. a driving force transmission member for transmitting a driving force to said developing cartridge mounted to said mounting member.

30. An apparatus according to claim 29 wherein a black developing cartridge for developing a latent image with black color toner, a yellow developing cartridge for developing a latent image with yellow color toner, magenta developing cartridge for developing a latent image with magenta color toner, and a cyan developing cartridge for developing a latent image with cyan color toner, are mountable to said mounting member.

31. An apparatus according to claim 29 wherein said electrophotographic photosensitive member is contained in a process cartridge detachably mountable to a main assembly of said image forming apparatus, said process cartridge further containing a charging member for charging said electrophotographic photosensitive member and cleaning member for removing residual toner from said electrophotographic photosensitive member.

32. An apparatus according to claim 29 wherein a driving force receptor means provided in said developing cartridge, is provided with a recess, which is engageable with a projection of said driving force transmission member to receive driving force from a motor.

33. An electrographic image forming apparatus for forming an image on a recording material, comprising:

a. an electrophotographic photosensitive member;

b. a first supporting member;

c. a second supporting member;

d. a first elastic member;

e. a second elastic member;

f. a first fixed portion;

g. a second fixed portion;

h. a mounting member for detachably mounting a developing cartridge, said developing cartridge comprising:

a developing roller for developing, with toner, the latent image formed on the photosensitive member of the main assembly of the apparatus, when said cartridge is mounted to the main assembly of the electrophotographic image forming apparatus;

a first projected portion outwardly projected from said cartridge frame portion adjacent one longitudinal end of said developing roller, wherein said first projected portion is supported by a first supporting member provided in the main assembly of the apparatus when said cartridge is mounted to the main assembly;

a second projected portion outwardly projected from said cartridge frame portion adjacent the other longitudinal end of said developing roller, wherein said second projected portion is supported by a second supporting member provided in the main assembly of the apparatus when said cartridge is mounted to the main assembly;

a first urging force receptor portion outwardly projected from said cartridge frame portion adjacent said one longitudinal end of said developing roller, wherein said first urging force receptor portion receives an urging force by a first elastic member provided in the main assembly when said cartridge is mounted to the main assembly;

a second urging force receptor portion outwardly projected from said cartridge frame portion adjacent the other longitudinal end of said developing roller, wherein said second urging force receptor portion receives an urging force by a second elastic member provided in the main assembly when said cartridge is mounted to the main assembly;

a first contact portion outwardly projected from said cartridge frame portion adjacent said one longitudinal end of said developing roller, wherein said first contact portion contacts a first fixed portion provided in the main assembly when said cartridge is mounted to the main assembly;

a second contact portion outwardly projected from said cartridge frame portion adjacent the other longitudinal end of said developing roller, wherein said second contact portion contacts a second fixed portion provided in the main assembly when said cartridge is mounted to the main assembly;

a driving force receptor member for receiving, from the main assembly, a driving force for rotating said developing roller when said cartridge is mounted to the main assembly, wherein said driving force receptor member is exposed from said cartridge frame portion adjacent one longitudinal end of said developing roller;

wherein as seen in the longitudinal direction of said developing roller, said first urging force receptor portion is disposed such that an angle formed between a first line connecting a center of rotation of said developing roller and a center of rotation of a driving force reception member and a second line connecting a portion of said first urging force receptor portion and the center of rotation of said driving force reception member, is 100–130 degrees, and said driving force reception member receives a driving force for rotating said developing roller when said developing cartridge is mounted to the main assembly, said second urging force receptor portion is disposed such that an angle formed between a first line connecting a center of rotation of said developing roller and a center of rotation of a driving force reception member and a line connecting a portion of siad second urging force reception member is 100–130 degrees, and said driving force reception member receives a driving force for rotating said developing roller when said developing cartridge is mounted to the main assembly; and i. a driving force transmission member for transmitting a driving force to said driving force receptor member of said developing cartridge when said cartridge is mounted to said mounting member.

34. An apparatus according to claim 33, wherein a black developing cartridge for developing a latent image with black color toner, a yellow developing cartridge for developing a latent image with yellow color toner, magenta developing cartridge for developing a latent image with magenta color toner, and a cyan developing cartridge for developing a latent image with cyan color toner, are mountable to said mounting member.

35. An apparatus according to claim 33 wherein said electrophotographic photosensitive member is contained in a process cartridge detachably mountable to a main assembly of said image forming apparatus, said process cartridge further containing a charging member for charging said electrophotographic photosensitive member and cleaning member for removing residual toner from said electrophotographic photosensitive member.

36. An apparatus according to claim 33 wherein said driving force transmission member has a projection, which is engageable with a recess of said driving force receptor member to transmit driving force.

37. An electrophotographic image forming apparatus for forming an image on a recording material, comprising:

a. an electrophotographic photosensitive member;

b. a first supporting member;

c. a second supporting member;

d. a first elastic member;

e. a second elastic member;

f. a first fixed portion;

g. a second fixed portion;

h. a mounting member for detachably mounting a developing cartridge, said developing cartridge comprising:

a developing roller for developing, with toner, the latent image formed on the photosensitive member of the main assembly of the apparatus, when said cartridge is mounted to the main assembly of the electrophotographic image forming apparatus;

a first projected portion outwardly projected from said cartridge frame portion adjacent one longitudinal end of said developing roller, wherein said first projected portion is supported by a first supporting member provided in the main assembly of the apparatus when said cartridge is mounted to the main assembly;

a second projected portion outwardly projected from said cartridge frame portion adjacent the other longitudinal end of said developing roller, wherein said second projected portion is supported by a second supporting member provided in the main assembly of the apparatus when said cartridge is mounted to the main assembly;

a first urging force receptor portion outwardly projected from said cartridge frame portion adjacent said one longitudinal end of said developing roller, wherein said first urging force receptor portion receives an urging force by a first elastic member provided in the main assembly when said cartridge is mounted to the main assembly, and wherein said first urging force receptor portion is integrally molded with a first frame member constituting said cartridge frame;

a second urging force receptor portion outwardly projected from said cartridge frame portion adjacent the other longitudinal end of said developing roller, wherein said second urging force receptor portion receives an urging force by a second elastic member provided in the main assembly when said cartridge is mounted to the main assembly, and wherein said second urging force receptor portion is integrally molded with a second frame member constituting said cartridge frame;

a first contact portion outwardly projected from said cartridge frame portion adjacent said one longitudinal end of said developing roller, wherein said first contact portion contacts a first fixed portion provided in the main assembly when said cartridge is mounted to the main assembly, wherein said first contact portion is integrally molded with the first frame member constituting said cartridge frame;

a second contact portion outwardly projected from said cartridge frame portion adjacent the other longitudinal end of said developing roller, wherein said second contact portion contacts a second fixed portion provided in the main assembly when said cartridge is mounted to the main assembly, and wherein said second contact portion is integrally molded with the second frame member constituting said cartridge frame;

a driving force receptor member for receiving, from the main assembly, a driving force for rotating said developing roller when said cartridge is mounted to the main assembly, wherein said driving force receptor member is exposed from said cartridge frame portion adjacent one longitudinal end of said developing roller;

wherein as seen in the longitudinal direction of said developing roller, each of said first and second urging force receptor portions is disposed such that an angle formed between a first line connecting a center of rotation of said developing roller and a center of rotation of a driving force reception member and a second line connecting a portion of said first or second urging force receptor portion and the center of rotation of said driving force reception member, is 100–130 degrees, and said driving force reception member receives a driving force for rotating said developing roller when said developing cartridge is mounted to the main assembly, and wherein as seen in the longitudinal direction of said developing roller each of said first and second contact portions is disposed such that an angle formed between said first line and a third line connecting a center of said first or second contact portion and a center of rotation of said driving force reception member, is 130–150 degrees; and j. a driving force transmission member for transmitting a driving force to said driving force receptor member of the developing cartridge when said cartridge is mounted to said mounting member.

38. An apparatus according to claim 37 wherein a black developing cartridge for developing a latent image with black color toner, a yellow developing cartridge for developing a latent image with yellow color toner, magenta developing cartridge for developing a latent image with magenta color toner, and a cyan developing cartridge for developing a latent image with cyan color toner, are mountable to said mounting member.

39. An apparatus according to claim 37 wherein said electrophotographic photosensitive member is contained in a process cartridge detachably mountable to a main assembly of said image forming apparatus, said process cartridge further containing a charging member for charging said electrophotographic photosensitive member and cleaning member for removing residual toner from said electrophotographic photosensitive member.

40. An apparatus according to claim 37 wherein said driving force transmitting member has a projection, which is engageable with a recess of said driving force receptor member to transmit the driving force.

41. A developing cartridge for developing a latent image formed on a photosensitive member, wherein said developing cartridge is detachably mountable to a main assembly of an electrophotographic image forming apparatus, said developing cartridge comprising:

a cartridge frame;

a developing member for developing, with the toner, the latent image formed on the photosensitive member of the main assembly of the apparatus, when said cartridge is mounted to the main assembly of the electrophotographic image forming apparatus;

a first projected portion outwardly projected from said cartridge frame portion adjacent one longitudinal end of said developing member, wherein said first projected portion is supported by a first supporting member provided in the main assembly of the apparatus when said cartridge is mounted to the main assembly;

a second projected portion outwardly projected from said cartridge frame portion adjacent the other longitudinal end of said developing member, wherein said first projected portion is supported by a second supporting member provided in the main assembly of the apparatus when said cartridge is mounted to the main assembly;

an urging force receptor portion outwardly projected from said cartridge frame portion adjacent said one longitudinal end of said developing member, wherein said urging force receptor portion receives an urging force by an elastic member provided in the main assembly when said cartridge is mounted to the main assembly; and a contact portion outwardly projected from said cartridge frame portion adjacent said one longitudinal end of said developing member, wherein said contact portion contacts a fixed portion provided in the main assembly when said cartridge is mounted to the main assembly.

42. A cartridge according to claim 41, wherein as seen in the longitudinal direction of a developing roller of said developing means, said urging force receptor portion is disposed such that an angle formed between a first line connecting a center of rotation of said developing roller and a center of rotation of a driving force reception member and a second line connecting a portion of said first urging force receptor portion for receiving the elastic force and the center of rotation of said driving force reception member, is 100–130 degrees, and said a driving force reception member receives a driving force for rotating said developing roller when said developing cartridge is mounted to the main assembly.

43. A cartridge according to claim 42, wherein as seen in the longitudinal direction of said developing roller, said first contact portion is disposed such that an angle formed between said first line and a third line connecting a center of the first contact portion and a center of rotation of said driving force reception member, is 130–150 degrees.

44. A cartridge according to claim 41, wherein said urging force receptor portion is in the form of flat plates, and receive the urging force by said elastic member.

45. A cartridge according to claim 44, wherein said urging force receptor portion is integrally molded with a frame member constituting said cartridge frame.

46. A cartridge according to claim 44 or 45, wherein said urging force receptor portion is projected outwardly from said cartridge frame by 2 m–20 mm.

47. A cartridge according to claim 41, wherein said contact portion is in the form of circular column, and its peripheral surface portion contacts said fixed portion.

48. A cartridge according to claim 47, wherein said first contact portion is integrally molded with said cartridge frame, and said second contact portion is integrally molded with said cartridge frame.

49. A cartridge according to claim 47 or 48, wherein said contact portion is outwardly projected from said cartridge frame by 2mm–15mm.

50. A cartridge according to claim 41, wherein said first projected portion and said second projected portion have flat surface portions and curved surface portions, and said curved surface portions are rotatably engaged with said first supporting member and second supporting member, respectively.

51. A developing cartridge for developing a latent image formed on a photosensitive member, wherein said developing cartridge is detachably mountable to a main assembly of an electrophotographic image forming apparatus, said developing cartridge comprising:

a cartridge frame;

developing member for developing, with the toner, the latent image formed on the photosensitive member of the main assembly of the apparatus, when said developing cartridge is mounted to the main assembly of the electrophotographic image forming apparatus;

a first projected portion outwardly projected from said cartridge frame portion adjacent one longitudinal end of said developing member, wherein said first projected portion is supported by a first supporting member provided in the main assembly of the apparatus when said developing cartridge is mounted to the main assembly;

a second projected portion outwardly projected from said cartridge frame portion adjacent the other longitudinal end of said developing member, wherein said second projected portion is supported by a second supporting member provided in the main assembly of the apparatus when said developing cartridge is mounted to the main assembly;

an urging force receptor portion outwardly projected from said cartridge frame portion in a longitudinal direction of said cartridge frame, wherein said urging force receptor portion receives an urging force by an elastic member provided in the main assembly when said developing cartridge is mounted to the main assembly; and a contact portion outwardly projected from said cartridge frame portion in a longitudinal direction of said cartridge frame, wherein said contact portion contacts a fixed portion provided in the main assembly when said developing cartridge is mounted to the main assembly.

52. A cartridge according to claim 51, wherein as seen in the longitudinal direction of a developing roller of said developing means, said urging force receptor portion is disposed such that an angle formed between the line connecting a center of rotation of said developing roller and a center of rotation of a driving force reception member and a second line connecting a portion of said first urging force receptor portion and the center of rotation of said driving force reception member, is 100–130 degrees, and said driving force reception member receives a driving force for rotating said developing roller when said developing cartridge is mounted to the main assembly.

53. A cartridge according to claim 52, wherein as seen in the longitudinal direction of said developing roller said first contact portion is disposed such that an angle formed between said first line and a third line connecting a center of said first contact portion and a center of rotation of said driving force reception member, is 130–150 degrees.

54. A cartridge according to claim 51, wherein said urging force receptor portion is in the form of flat plates, and receive the urging force by said elastic member.

55. A cartridge according to claim 54, wherein said urging force receptor portion is integrally molded with a frame member constituting said cartridge frame.

56. A cartridge according to claim 54 or 55, wherein said urging force receptor portion is projected outwardly from said cartridge frame by 2 mm–20 mm.

57. A cartridge according to claim 51, wherein said contact portion is in the form of a circular column, and its peripheral surface portion contacts said fixed portion.

58. A cartridge according to claim 57, wherein said first contact portion is integrally molded with said cartridge frame, and said second contact portion is integrally molded with said cartridge frame.

59. A cartridge according to claim 57 or 58, wherein said contact portion is outwardly projected from said cartridge frame by 2 mm–15 mm.

60. A cartridge according to claim 51, wherein said first projected portion and said second projected portion have flat surface portions and curved surface portions, and said curved surface portions are rotatably engaged with said first supporting member and second supporting member, respectively.

61. An electrographic image forming apparatus for forming an image on a recording material, comprising:

a. an electrophotographic photosensitive member;

b. a first supporting member;

c. a second supporting member;

d. an elastic member;

e. a fixed portion;

f. a mounting member for detachably mounting a developing cartridge, said developing cartridge comprising:

a developing member for developing, with toner, the latent image formed on the photosensitive member of the main assembly of the apparatus, when said cartridge is mounted to the main assembly of the electrophotographic image forming apparatus;

a first projected portion outwardly projected from said cartridge frame portion adjacent one longitudinal end of said developing member, wherein said first projected portion is supported by a first supporting member provided in the main assembly of the apparatus when said cartridge is mounted to the main assembly;

a second projected portion outwardly projected from said cartridge frame portion adjacent the other longitudinal end of said developing member, wherein said second projected portion is supported by the second supporting member provided in the main assembly of the apparatus when said cartridge is mounted to the main assembly;

an urging force receptor portion outwardly projected from said cartridge frame portion adjacent said one longitudinal end of said developing member, wherein said urging force receptor portion receives an urging force by the elastic member provided in the main assembly when said cartridge is mounted to the main assembly; and a contact portion outwardly projected from said cartridge frame portion adjacent said one longitudinal end of said developing member, wherein said contact portion contacts the fixed portion provided in the main assembly when said cartridge is mounted to the main assembly; and g. a driving force transmission member for transmitting a driving force to said developing cartridge mounted to said mounting member.

62. An electrographic image forming apparatus for forming an image on a recording material, comprising:

a. an electrophotographic photosensitive member;

b. a first supporting member;

c. a second supporting member;

d. an elastic member;

e. a fixed portion;

f. a mounting member for detachably mounting a developing cartridge, said developing cartridge comprising:

a developing member for developing, with toner, the latent image formed on the photosensitive member of the main assembly of the apparatus, when said developing cartridge is mounted to the main assembly of the electrophotographic image forming apparatus;

a first projected portion outwardly projected from said cartridge frame portion adjacent one longitudinal end of said developing member, wherein said first projected portion is supported by the first supporting member provided in the main assembly of the apparatus when said developing cartridge is mounted to the main assembly;

a second projected portion outwardly projected from said cartridge frame portion adjacent the other longitudinal end of said developing member, wherein said second projected portion is supported by the second supporting member provided in the main assembly of the apparatus when said developing cartridge is mounted to the main assembly;

an urging force receptor portion outwardly projected from said cartridge frame in a longitudinal direction of said cartridge frame, wherein said urging force receptor portion receives an urging force by the elastic member provided in the main assembly when said developing cartridge is mounted to the main assembly; and a contact portion outwardly projected from said cartridge frame portion in a longitudinal direction of said cartridge frame, wherein said contact portion contacts the fixed portion provided in the main assembly when said developing cartridge is mounted to the main assembly; and g. a driving force transmission member for transmitting a driving force to said developing cartridge mounted to said mounting member.

* * * * *

UNITED STATES PATENT AND TRADEMARK OFFICE

CERTIFICATE OF CORRECTION

PATENT NO. : 6,072,969
DATED : June 6, 2000
INVENTOR(S) : Kanji Yokomori, et al

It is certified that error appears in the above-identified patent and that said Letters Patent is hereby corrected as shown below:

Column 3:
Line 62, "FIG." should be deleted.
Line 65, "FIG." should be deleted.
Line 66, "and 12, illustrate" should read --and 12 illustrate--.

Column 7:
Line 12, "the-toner" should read --the toner--.
Line 38, "able" should read --ably--.
Line 62, "The" should read --the--.

Column 8:
Line 45, "14, This" should read –14. This--.

Column 9:
Line 1, "to" should read –into--.

Column 10:
Line 14, "operativity" should read --operativeness--.
Line 18, "as shown in" should be deleted.
Line 66, "off-set" should read --offset--.

Column 11:
Line 29, "it" should read --it is --.
Line 63, "FIG." should be deleted.

Column 12:
Line 5, "to" should read –into--.
Line 9, "to" should read --into--.
Line 29, "(b),FIG. 16" should read --(b). FIG. 16--.

UNITED STATES PATENT AND TRADEMARK OFFICE

CERTIFICATE OF CORRECTION

PATENT NO. : 6,072,969
DATED : June 6, 2000
INVENTOR(S) : Kanji Yokomori, et al.

It is certified that error appears in the above-identified patent and that said Letters Patent is hereby corrected as shown below:

Column 13:
Line 5, "is" should read --is made--.
Line 48, "holes 640a," should read –holes 64a,--.

Column 14:
Line 34, "to" should read --into--.

Column 15:
Line 1, "rib 59e," should read –rib 59e.--.

Column 16:
Line 21, "M1" should read --M2--.
Line 22, "M2" should read --M1--.
Line 28, "M1" should read --M2--.
Line 29, "M2" should read --M1--.

Column 19:
Line 48, "is" should read --are--.
Line 65, "of" should read --on--.

Column 22:
Line 29, "an" should read --a--.

Column 23:
Line 27, "assembly;" should read --assembly--.
Line 54, "reception" should read --receive--.

Column 24:
Line 1, "its" should read --their--.
Line 25, "with" should read --within--.

UNITED STATES PATENT AND TRADEMARK OFFICE

CERTIFICATE OF CORRECTION

PATENT NO. : 6,072,969
DATED : June 6, 2000
INVENTOR(S) : Kanji Yokomori, et al.

It is certified that error appears in the above-identified patent and that said Letters Patent is hereby corrected as shown below:

Column 25:
Line 48, "reception" should read --receive--.

Column 26:
Line 13, "claim 13" should read --claim 13,--.
Line 19, "claim 21" should read --claim 21,--.
Line 50, "one" should read --said one--.

Column 27:
Line 16, "frame;" should read --frame; and--.
Line 44, "reception" should read --receive--.
Line 47, "or 24" should read --or 24,--.
Line 51, "claim 23" should read --claim 23, --.
Line 53, "its" should read --their--.

Column 28:
Line 47, "assembly" should read --assembly; and --.
Line 57, "claim 29" should read --claim 29,--.
Line 60, "magenta" should read --a magenta--.

Column 29:
Line 12, "electrographic" should read --electrophotographic--.
Line 67, "assembly;" should read --assembly; and--.

Column 30:
Line 7, "roller;" should read --roller,--.
Line 37, "magenta" should read --a magenta--.
Line 42, "claim 33" should read --claim 33,--.
Line 50, "claim 33" should read --claim 33,--.

Column 31:
Line 53, "frame;" should read --frame; and--.
Line 60, "roller;" should read --roller,--.

UNITED STATES PATENT AND TRADEMARK OFFICE

CERTIFICATE OF CORRECTION

PATENT NO. : 6,072,969
DATED : June 6, 2000
INVENTOR(S) : Kanji Yokomori, et al.

It is certified that error appears in the above-identified patent and that said Letters Patent is hereby corrected as shown below:

Column 32:
Line 17, "claim 37" should read --claim 37,--.
Line 20, "magenta" should read --a magenta--.
Line 25, "claim 37" should read --claim 37,--.
Line 33, "claim 37" should read --claim 37,--.

Column 33:
Line 15, "a" should be deleted.
Line 27, "receive" should read --receives--.
Line 33, "2m." should read --2mm--.
Line 35, "of" should read --of a--.
Line 40, "receive" should read --recieves--.

Column 34:
Line 63, "electrographic" should read --electrophotographic--.

Column 35:
Line 40, "electrographic" should read –electrophotographic--.

Signed and Sealed this

Nineteenth Day of June, 2001

Nicholas P. Godici

*Attest:*

*Attesting Officer*

NICHOLAS P. GODICI
*Acting Director of the United States Patent and Trademark Office*